US007101648B2

(12) United States Patent
Itami

(10) Patent No.: US 7,101,648 B2
(45) Date of Patent: Sep. 5, 2006

(54) IMAGE FORMING METHOD AND IMAGE FORMING APPARATUS

(75) Inventor: Akihiko Itami, Hachioji (JP)

(73) Assignee: Konica Corporation, (JP)

( * ) Notice: Subject to any disclaimer, the term of this patent is extended or adjusted under 35 U.S.C. 154(b) by 157 days.

(21) Appl. No.: 10/630,245

(22) Filed: Jul. 30, 2003

(65) Prior Publication Data

US 2004/0072093 A1 Apr. 15, 2004

(30) Foreign Application Priority Data

Aug. 12, 2002 (JP) ..... 2002-234611

(51) Int. Cl.
*G03G 21/00* (2006.01)

(52) U.S. Cl. ..... 430/125; 430/126; 399/308

(58) Field of Classification Search ..... 430/125, 430/126; 399/308
See application file for complete search history.

(56) References Cited

U.S. PATENT DOCUMENTS 5,196,893 A * 3/1993 Nishise et al. ..... 399/279
5,629,117 A * 5/1997 Katsukawa et al. ..... 430/83
6,203,962 B1 * 3/2001 Itami et al. ..... 430/125
6,360,071 B1 * 3/2002 Tomizawa ..... 399/308
6,562,529 B1 * 5/2003 Kojima et al. ..... 399/308
2002/0045116 A1 * 4/2002 Morikawa et al. ..... 430/66

FOREIGN PATENT DOCUMENTS

JP 06-332324 12/1994
JP 06-337598 12/1994
JP 07-271142 10/1995

OTHER PUBLICATIONS

Diamond, Arthur S & David Weiss (eds.) Handbook of Imaging Materials. New York: Marcel-Dekker, Inc. (Nov. 2001) pp. 149-168.*

* cited by examiner

*Primary Examiner*—Christopher Rodee
(74) *Attorney, Agent, or Firm*—Squire, Sanders & Dempsey L.L.P.

(57) ABSTRACT

An image forming method is disclosed, in which a toner image on an organic photoreceptor developed by a two-component is primarily transferred to an intermediate transferring member, and secondarily transferred to a recording material, and a toner remained on the organic photoreceptor is cleaned after the transfer of the toner to the recording material, and the organic photoreceptor has a creeping modulus measured by pressing a Vickers indenter applying a load of 20 mN is not less than 1% and less than 3.5%. An image forming apparatus is also disclosed.

14 Claims, 6 Drawing Sheets

FIG. 6 ( a )
TONER HAVING NO CORNERS
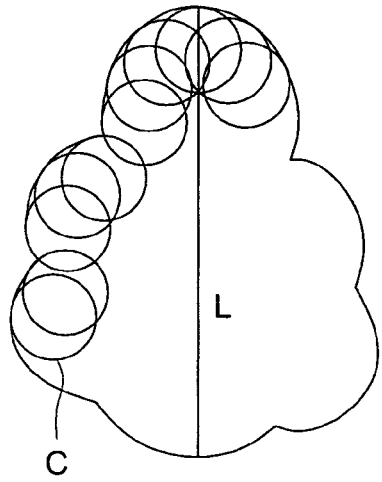
FIG. 6 ( b )
TONER HAVING CORNERS
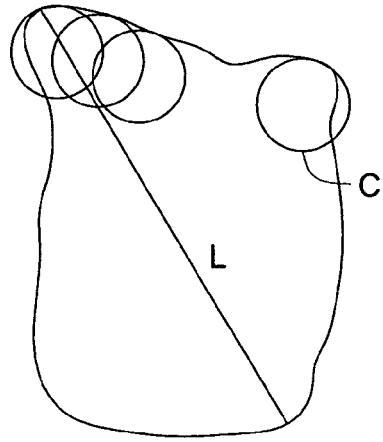
FIG. 6 ( c )
TONER HAVING CORNERS
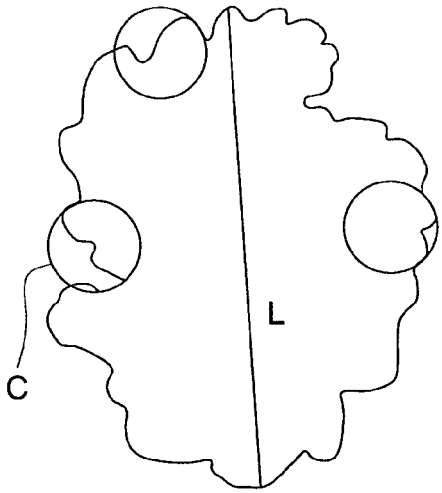

IMAGE FORMING METHOD AND IMAGE FORMING APPARATUS

FIELD OF THE INVENTION

The present invention relates to an image forming method and an image forming apparatus to be applied for copying machines, printers and facsimile machines.

BACKGROUND OF THE INVENTION

Hitherto, as the method for transferring a toner image formed on an organic photoreceptor onto a recording material to form a final image, a method has been known by which the toner image formed on the organic photoreceptor, herein after occasionally referred to photoreceptor, is directly transferred on to the recording material. On the other hand, an image forming method employing an intermediated transferring member has been known. According to such the method, a transferring step is further inserted in the process for transferring the toner image from the organic photoreceptor to the recording material. Namely, the toner image is primarily transferred from the organic photoreceptor onto the intermediate transferring member and then the primarily transferred toner image on the intermediate transferring member is secondarily transferred to the recording material to obtain the final image. Of these, the intermediate transfer system is frequently applied for piling transfer of toner images each having different color in a full color image forming apparatus by which a colored original image is separated and reproduced by subtractive color system employing black, cyan, magenta and yellow toners.

However, problems relating to the intermediate transferring member have been occurred in the foregoing intermediate transfer system. One of these is that carrier particles adhered to the photoreceptor is pushed into the photoreceptor by the pressure by the intermediate member and causes a crater-like damage having swollen on both sides on the surface of the photoreceptor. The crater-like damage causes damage on cleaning blade. As a result of that, the cleaning of the toner is made insufficient and slipping of the toner through the cleaning blade and line-shaped image defects are occurred. Such the phenomena further cause partially lowering of the sensitivity and the transfer ability of the toner so that a image defects such as partially lacking of character image so called as interior lacking are occurred and sharpness of the image tends to be degraded.

Besides, technique for lowering the surface energy of the intermediate transferring member by supplying a solid lubricant to improve the secondary transfer of the toner from the intermediate transferring member to the image recording material is disclosed in, for example, Japanese Patent Publication Open to Public Inspection (JP-A) Nos. 6-337598, 6-332324 and 7-271142. However, such the lowering of the surface energy of the intermediate transferring member is insufficient for improving the total transferring ability of the image forming system having two-step transfer process employing the intermediate transferring member since such the lowering of the surface energy of the intermediated transferring member causes decreasing of the transfer ratio of the from the photoreceptor to the intermediate transferring member. It is found that further improvement is required for forming copy images under a high temperature and high humidity condition or for a prolonged period.

Namely, it has been found as to the system employing the intermediate transferring member that it is necessary to totally improve both of the primary and secondary transfer by improvement of the surface property of both of the organic photoreceptor and the intermediate transferring member.

SUMMARY OF THE INVENTION

The object of the invention is to provide an image forming method and an image forming apparatus without occurrence of the image defects such as the line-shaped defects and the interior lacking by solving the aforesaid technical problems for preventing the occurrence of the image defects caused by the image formation on the surface of the photoreceptor and improving of the toner transfer ability in the image forming system employing the intermediate transferring member.

It has been found by the inventors that the foregoing problems of the image forming method employing the intermediate transferring member can be solved by giving elasticity to the surface property of the organic photoreceptor so that the damage formed on the photoreceptor surface does not destroy the cleaning blade even when the rigid substance such as the carrier is adhered to the photoreceptor.

It is further found that the image defects such as the occurrence of the line-shaped defects and the interior lacking of the image can be prevented and an electro photographic image with high sharpness can be obtained when the photoreceptor is become to be difficultly damaged by supplying the surface energy lowering agent, the transferring ability of the toner from the photoreceptor to the intermediate transferring member is raised by improving the transferring ability of the toner from the photoreceptor to the intermediate transferring member.

The invention and embodiments of this invention are described.

1. An image forming method comprising the steps of forming a latent image on an organic photoreceptor developing a latent image by using a two-component developer, primarily transferring the toner image appeared by the foregoing development to an intermediate transferring member, secondarily transferring the toner image transferred to the intermediate transferring member to a recording material, and cleaning the toner remained on the organic photoreceptor after the transfer of the toner to the recording material, wherein the creeping modulus of the organic photoreceptor measured by pressing by a Vickers indenter applying a load of 20 mN is not less than 1% and less than 3.5%.

It is preferred that the image formation is carried out while supplying a surface energy lowering agent to the surface of the organic photoreceptor.

The surface energy lowering agent is preferably a metal salt of fatty acid.

The metal salt of fatty acid is preferably zinc stearate.

The organic photoreceptor has a charge generation layer, a charge transfer layer and a surface layer.

The surface layer contains micro particles having a number average particle diameter of not less than 10 nm and less than 100 nm.

The intermediate transferring member is a belt intermediate transferring member which is contacted to the organic photoreceptor by a surface pressure of from 0.1 to 0.5 g/cm$^2$.

The cleaning process has a cleaning blade having a repulsion elasticity of from 40 to 75 which is pressed to the organic photoreceptor for removing the remained toner.

An image forming apparatus comprising;

an organic photoreceptor forming a latent image, a developing member forming a toner image on the photoreceptor, an intermediate transferring member, a primary transferring member transferring the toner image on the photoreceptor to the intermediate transferring member, a second transferring member transferring the transferred toner image on the intermediate transferring member to a recording material, and a cleaning member removing toner particles remained on the organic photoreceptor, wherein the organic photoreceptor has a creeping modulus measured by employing a Vickers indenter applying a load of 20 mN of not less than 1% and less than 3.5%.

The image forming apparatus further comprising a surface energy lowering agent supplying member supplying a surface energy lowering agent to the surface of the organic photoreceptor.

BRIEF DESCRIPTION OF THE DRAWINGS

FIG. 6(*a*) shows a projection image of toner particle having no corner and (b) and (c) each shows a projection image having a corner.

DETAILED DESCRIPTION OF THE INVENTION

A satisfactory image can be formed by the image forming method employing the intermediate transferring member by preventing the insufficient cleaning and the interior lacking of image by applying the foregoing constitution.

The present invention is described in detail below.

Figure 1:
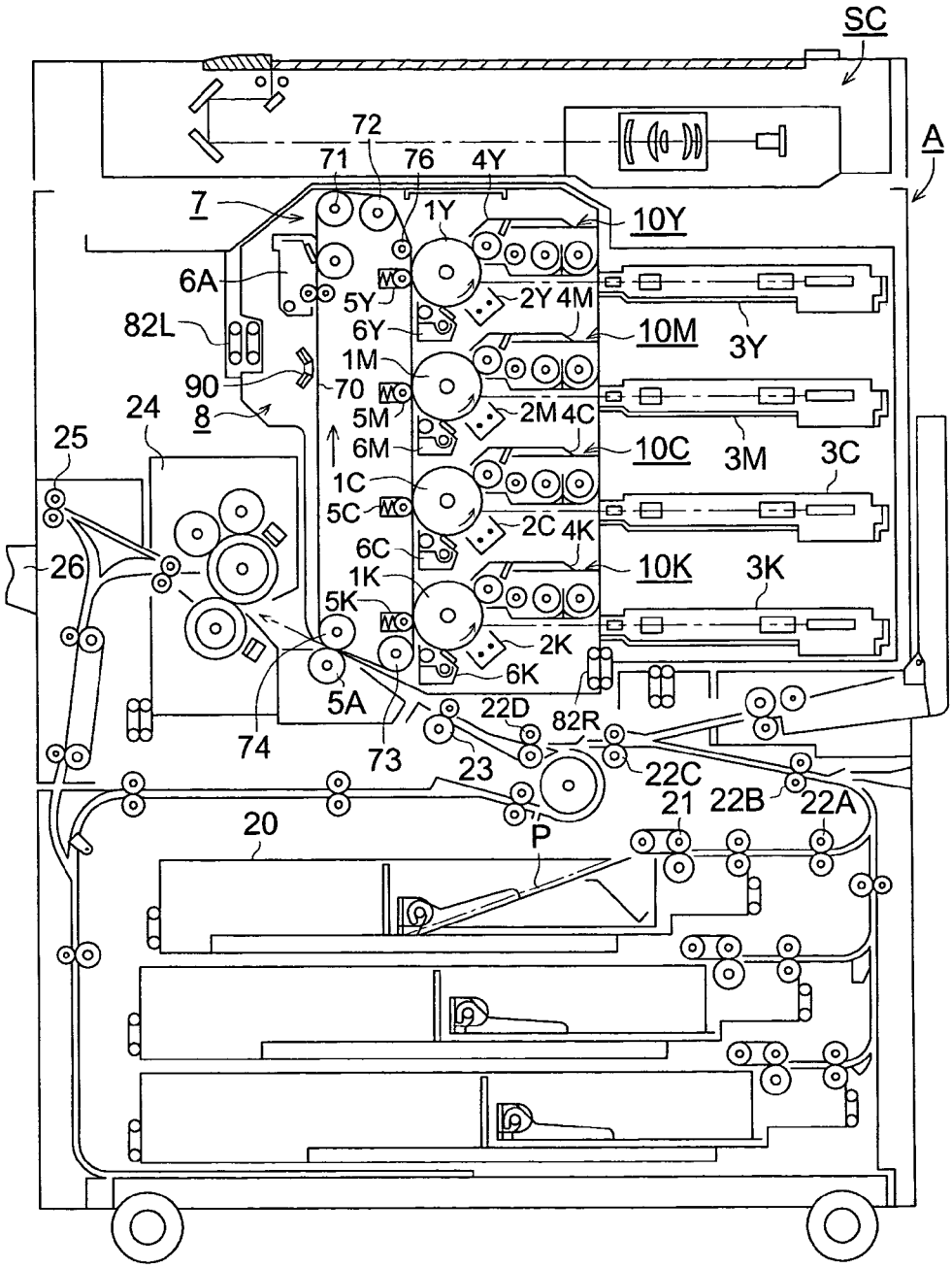
FIG. 1 shows a schematic cross section of a color image forming apparatus as an embodiment of the invention.

Image forming apparatus main body GH, shown in FIG. 1, is one called a tandem type color image forming apparatus, and comprises plural-unit comprising image forming sections 10Y, 10M, 10C, and 10K, belt-shaped intermediate transfer body 7, a fed paper conveying means, and fixing unit 24. An image original reading unit SC is arranged at the upper portion of main body A of the image forming apparatus.

Image forming section 10Y which forms yellow images comprises charging means 2Y which is arranged around photoreceptor 1Y as an electrostatic latent image forming member, image exposure means 3Y, toner development means 4Y, primary transfer roller 5Y as primary transfer means, and cleaning means 6Y. Image forming section 10M, which forms magenta images, comprises photoreceptor 1M as an image forming body, charging means 2M, image exposure means 3M, toner development means 4M, primary transfer roller 5M as primary transfer means, and cleaning means 6M. Image forming section 10C, which forms cyan images, comprises photoreceptor 1C as an image forming body, charging means 2C, image exposure means 3C, toner development means 4C, primary transfer roller 5C as primary transfer means, and cleaning means 6C. Image forming section 10K, which forms black images, comprises photoreceptor 1K as an image forming body, charging means 2K, image exposure means 3K, toner development means 4K, primary transfer roller 5K as primary transfer means, and cleaning means 6K.

An intermediate image receiving unit 7 comprises an endless belt-form intermediate image receiving member 70, which is a looped belt and is sustained by a plurality of rollers so as to be rotatable.

Each of color images formed by image forming sections 10Y, 10M, 10C, and 10K is successively transferred (primary transfer) onto rotating intermediate image receiving member 70 employing transfer means 5Y, 5M, 5C, and 5K, whereby a superimposed color image is formed.

Image receiving member P, which is housed in paper feeding cassette 20, is fed by paper feeding means 21, and is conveyed to secondary transfer means 5A via paper feeding rollers 22A, 22B, 22C, and resist roller 23, whereby a color image comes into contact with and transferred (secondary transfer) onto image receiving member P. Image receiving member P, onto which said color image has transferred, is subjected to fixing treatment employing fixing unit 24, subsequently held by paper ejecting rollers 25, and ejected onto paper ejecting tray 26 placed in the exterior of the apparatus.

On the other hand, after transferring said color image onto image receiving member P employing secondary transfer means 5A, said image receiving member P is separated from endless belt-form intermediate image receiving member 70. Subsequently, residual toner on intermediate image receiving member 70 is removed by cleaning means 6A.

The primary transfer roller 5K is always pressed to contact with the photoreceptor 1K during the image forming process. The other primary transfer rollers 5Y, 5M, and 5C, each is pressed to contact with the corresponding photoreceptors 1Y, 1M and 1C at the image formation process only.

Secondary transfer roller 5A is press contacted with endless belt-form intermediate transfer element 70 only when a secondary transfer is performed by passing paper P therethrough.

Further, removable box element 8 is possible to be drew out from apparatus main body A through support rails 82L and 82R.

Removal box element 8 is constituted of image forming portions 10Y, 10M, 10C and 10K, and endless belt-form intermediate transfer element unit 7.

Image forming portions 10Y, 10M, 10C and 10K are vertically arranged in a column. Endless belt-form intermediate transfer element unit 7 is arranged at the illustrated left side of photoreceptors 1Y, 1M, 1C and 1K. Endless belt-form transfer element unit 7 is constituted of endless belt-form transfer element 70 which is rotatable winding around rollers 71, 72, 73 and 74; primary transfer rollers 5Y, 5M, 5C and 5K; and cleaning means 6A.

Figure 2:
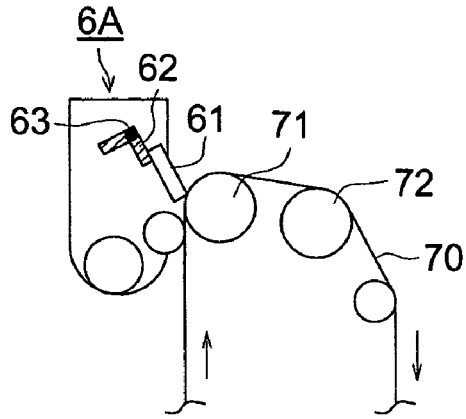
FIG. 2 shows an example of the cleaning means for the intermediate transferring member.

FIG. 2 shows an example of a cleaning means for an intermediate transfer element. A cleaning means for an intermediate transfer element is constituted of blade 61 attached to bracket 62 which is controlled so as to be rotatable around support shaft 63 as shown in FIG. 2, and is possible to adjust the blade pressing pressure against roller 71 by changing spring weight or loading weight.

Image forming portions 10Y, 10M, 10C and 10K, together with endless belt-form intermediate transfer element unit 7, are drew out as one unit, from main body A by a drawing out operation of box element 8.

Support rail 82L on the illustrated left side of box element 8 is arranged on the left side of endless belt-form intermediate transfer element 70 and in the upper space portion of fixing means 24. Support rail 82R on the illustrated right side of box element 8 is arranged in the neighboring of under lowermost development means 4K. Support rail 82R is arranged at a position where the mounting and dismounting operations of development means 4Y, 4M, 4C and 4K on and from box element 8 is not interfered.

Photoreceptors 1Y, 1M, 1C and 1K in box element 8 are surrounded by development means 4Y, 4M, 4C and 4K at the illustrated right side, by such as electric charging means 2Y, 2M, 2C and 2K and cleaning means 6Y, 6M, 6C and 6K at the illustrated lower side, and by endless belt-form intermediate transfer element 70 at the illustrated left side.

Among them, such as a photoreceptor, a cleaning means and an electric charging means constitute one photoreceptor unit, and such as a development means and a toner supply device constitute one development unit.

Figure 3:
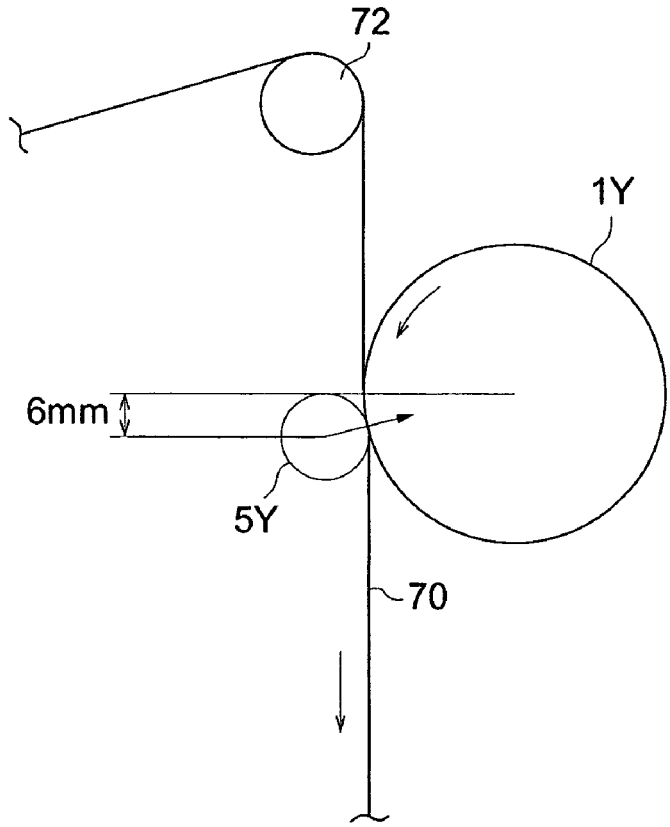
FIG. 3 shows a drawing of arrangement showing the relative position of the endless belt-shaped intermediate transferring member and the primary transfer roller.

FIG. 3 is an arrangement drawing showing a positional relationship of a photoreceptor, an endless belt-form intermediate transfer element and a primary transfer roller. Primary transfer rollers 5Y, 5M, 5C and 5K are pressed from behind endless belt-form intermediate transfer element 70 as an intermediate transfer element against each photoreceptor 1Y, 1M, 1C and 1K; and primary transfer rollers 5Y, 5M, 5C and 5K are arranged more down-stream, in a rotating direction of a photoreceptor, than the contact point of endless belt-form intermediate transfer element 70 with each photoreceptor 1Y, 1M, 1C and 1K, when they are not in a state of being pressed, and pressed against each photoreceptor 1Y, 1M, 1C and 1K; as is shown in FIG. 3. At this time, in the constitution, endless belt-form transfer element 70 as an intermediate transfer element is bent so as to follow the outer circumference of each photoreceptor 1Y, 1M, 1C and 1K, and primary transfer rollers 5Y, 5M, 5C and 5K are arranged at most down-stream in the contact range of a photoreceptor with endless belt-form intermediate transfer element 70.

Figure 4:
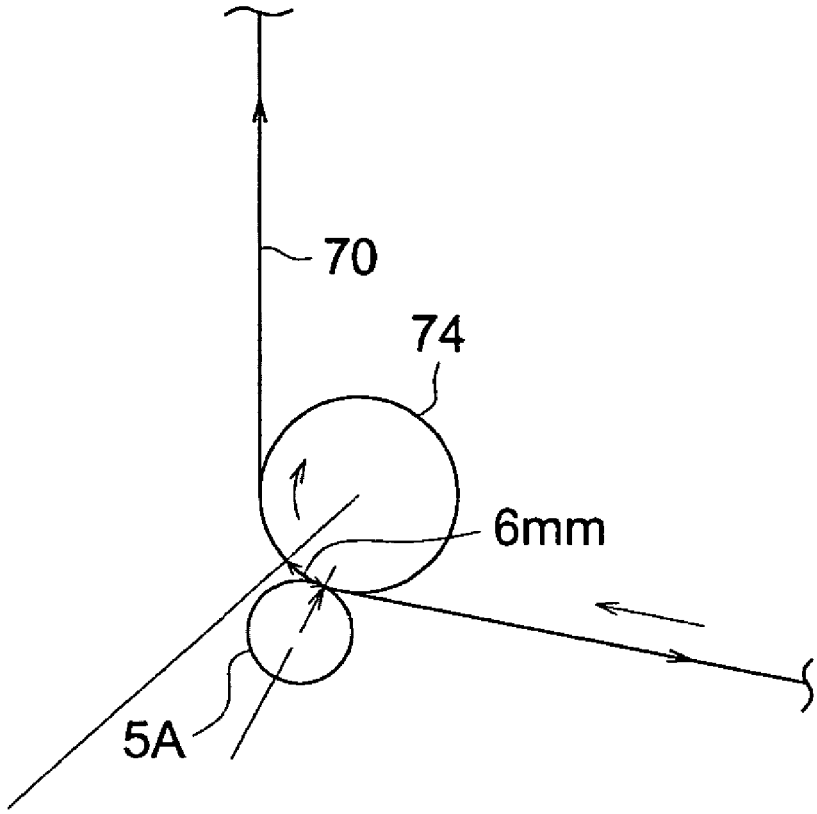
FIG. 4 shows an arrangement of the relative positions of the backup roller, the endless belt-shaped intermediate transferring member and the secondary transfer roller.

FIG. 4 is an arrangement drawing showing a positional relationship of back-up roller, an endless belt-form transfer element and a secondary transfer roller. Secondary transfer roller 5A is preferably arranged, as is shown in FIG. 4, at upper-stream in a rotating direction of back-up roller 74, than the center of a contact portion of endless belt-form intermediate transfer element 70 as an intermediate transfer element, with back-up roller 74, when they are not in a state of being pressed by secondary transfer roller 5A.

As an intermediate transfer element, utilized are polymer films such as polyimide, polycarbonate and PVdF, synthetic rubbers such as silicone rubber and fluorine-contained rubber, which having been made electric conductive by adding an electric conductive filler such as carbon black; either a drum-form or a belt-form is applicable, however, a belt-form is preferable in respect to latitude in apparatus design.

The intermediate transfer element of the invention preferably has a ten-point surface roughness Rz of from 0.4 to 2.0 μm. By employing an intermediate transfer element having such surface roughness, an excess contact pressure to the surface of the photoreceptor is relaxed, whereby crater-like damage is restrained, and toner adhesion force to the intermediate transfer element is reduced whereby transfer efficiency of toner from the intermediate transfer element to a recording sheet improves.

Ten point average surface roughness Rz

In the invention, the surface roughness Rz of the intermediate transferring member is difference of the average level of the highest five points and that of the lowest five points within the distance of 0.25 mm.

Although the measurement is carried out by a surface roughness meter Surfcorder SE-30H, manufactured by Kosaka Kenkyujo Co., Ltd., but another measuring apparatus may be used as long as by which the same results can be obtained within the error range.

Measuring condition of the surface roughness Rz

Driving speed: 0.1 mm/second

Stylus diameter: 2 μm

The Rz of the intermediate transferring member according to the invention is from 0.4 to 2.0 μm and is preferably from 0.5 to 1.8 μm.

For roughing the surface of the intermediate transferring member, a method by adding micro particles having a diameter of from about 0.2 to 10 μm or an electroconductive filler into a polymer film or synthesized rubber and a method by sand blast treatment by which fine particles are collided to the surface of the support are applicable. However, the method for roughing the surface of the intermediate transferring member is not limited to the aforesaid methods.

The surface pressure of the intermediate transferring member to the organic photoreceptor on the occasion of the primary transfer of the toner from the organic photoreceptor to the intermediate transferring member is preferably from 0.1 to 0.5 g/cm$^2$. When the pressure is less than 0.1 g/cm$^2$, the transfer tend to be insufficient and when the pressure exceeds 0.5 g/cm$^2$, the carrier tends to be buried into the photoreceptor so that the cleaning blade tends to be damaged.

That is, the present invention is preferably provided with an agent applying means in which a surface energy-lowering agent is supplied on the surface of a photoreceptor. An agent applying means can be installed at a suitable position in the neighborhood of a photoreceptor, and may be installed utilizing a part of a charging means, developing means or cleaning means which are illustrated in FIG. 1 to effectively make the most of install space. An example will be described below in which an agent applying means is combined with a cleaning means.

Figure 5:
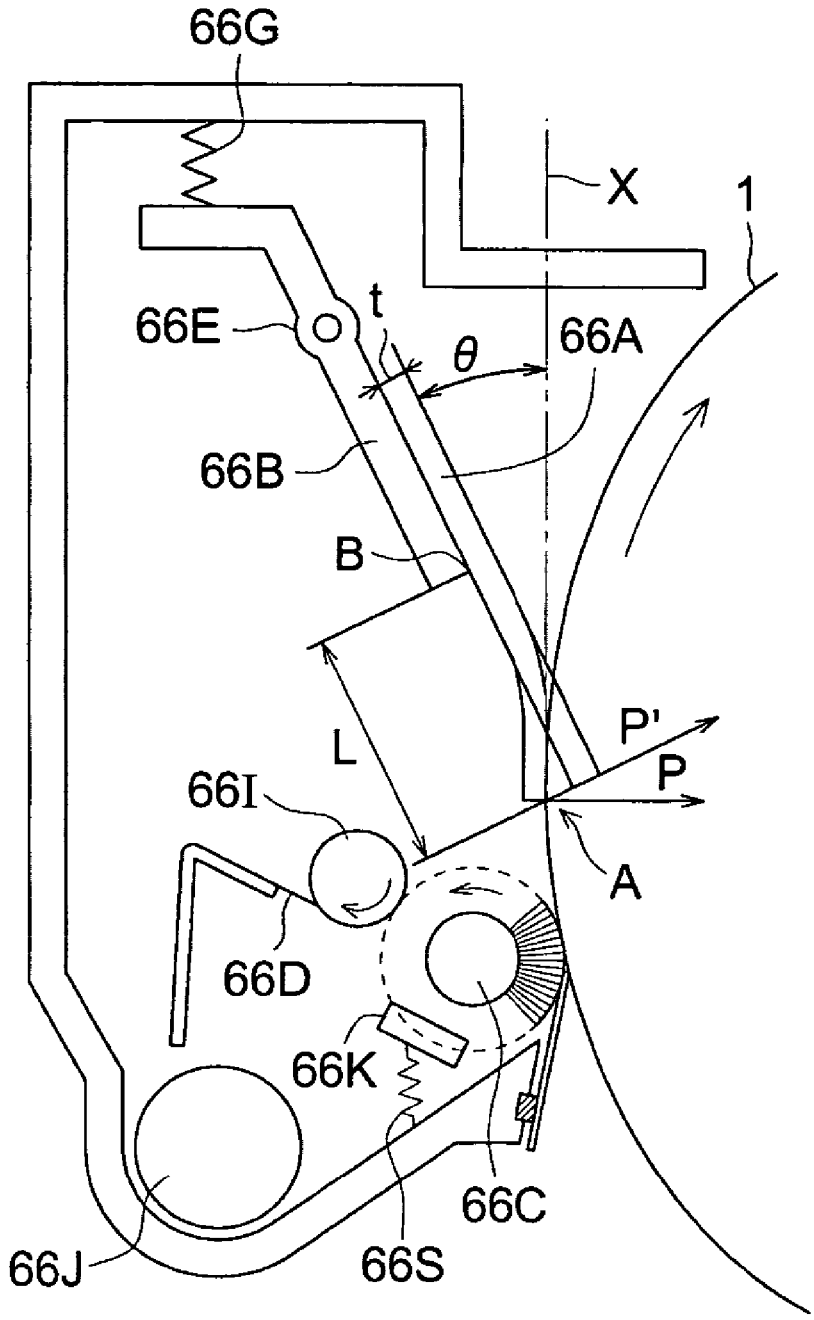
FIG. 5 shows a constitution of cleaning member to be attached to the photoreceptor according to the invention.

FIG. 5 is a constitutional drawing of a cleaning means mounted on a photoreceptor of the invention. The cleaning means is utilized as a cleaning means of such as 6Y, 6M, 6C and 6K in FIG. 1. Cleaning blade 66A of FIG. 5 is attached to support member 66B. As a material for the cleaning blade, utilized are rubber elastomers, such as urethane rubber, silicone rubber, fluorine-contained rubber, chloroprene rubber and butadiene rubber are well known, and among them specifically preferable is urethane rubber in respect to an excellent abrasion-resistance compared to other rubbers.

The cleaning blade employed in the present invention is preferably comprised of elastic rubber materials having a hardness of 65° to 75°. Physical property parameters, hardness and impact resilience, of the elastic body rubber blade employed in said cleaning blade are measured employing JIS K6301 Vulcanized Rubber Physical Test Method.

Support member 66B is constituted by a plate-form metal or plastic members. Preferable metal members are such as a stainless steel plate, an aluminum plate or a damping steel plate.

In the invention, the top edge of a cleaning blade, which is in pressing contact with the surface of a photoreceptor, is preferably brought in pressing contact in a state of weight loaded toward the opposite direction (counter direction) to a rotating direction of a photoreceptor. A top edge of a cleaning blade preferably forms a press contacted surface when it is brought in pressing contact with a photoreceptor, as shown in FIG. 5.

Press contact weight P and contact angle θ of a cleaning blade against a photoreceptor are preferably as follows: P is from 5 to 40 N/m and θ is from 5 to 35°.

Press contact weight P is a vector value in perpendicular direction of press power P' when cleaning blade 66A is in pressing contact with photoreceptor 1.

Press contact angle θ represents an angle between a tangent X and a blade before being deformed, at contact point A of a photoreceptor. 66E represents a rotation axis which make a support member rotatable, and 66G represents a load spring.

Further, free length L of the above-described cleaning blade represents, as shown in FIG. 5, a length from the edge B of support member 66B to the top edge of a blade before being deformed. The free length is preferably from 6 to 15 mm, and the thickness of a cleaning blade (t) is preferably from 0.5 to 10 mm. Wherein, a thickness of a cleaning blade is defined, as shown in FIG. 5, a perpendicular direction to the adhered surface of support member 66B.

In a cleaning means of FIG. 5, utilized is brush roller 66C which serve also as an agent applying means. The brush roller provided with a function as an applying means which supply a surface energy-lowering agent on a photoreceptor together with functions to remove a toner adhered on a photoreceptor and to recover a toner removed by cleaning blade 66A. That is, the brush roller contacts with photoreceptor 1 and rotates in the same direction as the progressing direction of a photoreceptor at the contact portion; thereby, it removes a toner or paper dust on a photoreceptor, as well as conveys the toner removed by cleaning blade 66A to be recovered into convey screw 66J. As pathway during the process, it is preferable to remove removed materials such as a toner which have been transferred from a photoreceptor to brush roller 66C by bringing brush roller 66C in pressing contact with flicker 66I as a removing means. Further, a toner adhered to the flicker is removed by scrubber 66D to recover a toner into convey screw 66J. A toner recovered is taken out of an apparatus as waste or reused by being conveyed through a recycle pipe for reuse (not shown in the figure) to a development device. As materials for flicker 66I, preferably used is a metal pipe such as made of stainless steel or aluminum. On the other hand, as scrubber 66D, utilized are elastic plates such as a phosphor bronze plate, a polyethylene terephthalate plate and polycarbonate plate, and the top edge thereof is preferably brought in pressing contact in a counter-way forming an acute angle against the rotating direction of a flicker.

Further, surface energy-lowering agent 66K (a solid material such as zinc stearate) is attached to a brush roller being pressed by spring load 66S, and the brush abrades, while being rotated, the surface energy-lowering agent to supply it on the surface of a photoreceptor. Although a surface energy-lowering agent is a rectangular solid-shaped in FIG. 5, it may be a circular cylinder-shaped.

A brush roller made of an electric conductive or semi-conductive material is utilized as brush roller 66C.

As a brush constitution material for a brush roller utilized in the invention, arbitrary materials can be used, however, a fiber-forming high polymer which is hydrophobic and has a high dielectric constant is preferably used. Such high polymers include, for example, rayon, nylon, polycarbonate, polyester, methacrylic resin, acrylic resin, polyvinyl chloride, polyvinylidene chloride, polypropylene, polystyrene, polyvinyl acetate, styrene-butadiene copolymer, vinylidene chloride-vinyl acetate copolymer, vinylidene chloride-vinyl acetate-maleic anhydride copolymer, silicone resin, silicone-alkyd resin, phenol formaldehyde resin, styrene-alkyd resin, polyvinyl acetal (e.g., polyvinyl butyral), etc. These binder resins can be utilized alone or in combinations of two or more kinds. Specifically preferable are rayon, nylon, polyester, acrylic resin and polypropylene.

Further, as the brush described above, conductive or semi-conductive one is utilized, and can be utilized one having an arbitrarily adjusted specific resistance by including a substance having a low resistance such as carbon as a constituent material.

The specific resistance of a brush hair of a brush roller is preferably in a range of from $10^1$ to $10^6$ Ωcm, when it is measured under ordinary temperature and humidity (a temperature of 26° C. and a relative humidity of 50%) in a state of an electric voltage of 500 V being applied on the both ends of a brush hair of 10 cm long.

That is, a brush roller is preferably made of a core material such as stainless steel with conductive or semi-conductive brush hair having a specific resistance of $10^1$ to $10^6$ Ωcm. In case of a specific resistance of lower than $10^1$ Ωcm, it is liable to produce such as banding due to discharge; while, in case of higher than $10^6$ Ωcm, it is liable to cause poor cleaning due to a reduced potential difference from a photoreceptor.

The thickness of a brush hair utilized for a brush roller is preferably from 5 to 20 deniers. When it is less than 5 deniers, surface adhered substances unable to be removed due to insufficient abrasion pressure. When it is not less than 20 deniers, a brush becomes rigid to hurt the surface of a photoreceptor as well as to cause abrasion to proceed, resulting in a shortened life of a photoreceptor.

Herein, "denier" is a measured value based on a weight in a gram unit of a 9,000 m long brush hair (fiber) constituting the above-described brush.

The density of brush hairs of the brush described above is from $4.5\times10^2/cm^2$ to $2.0\times10^4/cm^2$ (number of brush hairs per one square centimeter). When it is less than $4.5\times10^2/cm^2$, not only rigidity is low and abrasion pressure is weak but also uneven abrasion is caused, which makes uniform removal of adhered substances impossible. When it is not less than $2.0\times10^4/cm^2$, a brush becomes rigid to increase abrasion pressure which abrade a photoreceptor, resulting in generation of image defects such as fog due to reduced sensitivity and black streaks due to abrasion marks.

The intrusion amount of a brush roller into a photoreceptor is preferably adjusted to from 0.4 to 1.5 mm, and more preferably to from 0.5 to 1.2 mm. This intrusion amount means a load, which is generated by relative movement of a photoreceptor and a brush roller and is applied on a brush. From a standpoint of a photoreceptor drum, the load corresponds to abrasion pressure received from a brush, and to regulate the pressure range means that a photoreceptor is necessarily being abraded with appropriate pressure.

The intrusion amount represents an intruding length assuming that brush hairs penetrated linearly into the body without bending at the surface of a photoreceptor when a brush is brought in pressing contact with a photoreceptor.

Since abrasion pressure by a brush at the surface of a photoreceptor is low with a photoreceptor being supplied with a surface energy-lowering agent, it is unable to depress filming of a toner or paper dust on the surface of a photoreceptor when an intrusion amount is not more than 0.4 mm, resulting in generation of defects such as unevenness on a image. On the other hand, when it is not less than 1.5 mm, abrasion amount of a photoreceptor becomes large due to an excess abrasion pressure on the surface of a photoreceptor by a brush, which is problematic because there caused fogging due to a decreased sensitivity or streak defect on a image due to generation of abrasion marks on the surface of a photoreceptor.

As a roll core material for a brush roll used in the invention, mainly utilized are metals such as stainless steel and aluminum; paper, plastic, etc.

A brush roll is preferably constituted by setting a brush on the surface of a cylindrical core material via an adhesive layer.

A brush roll preferably rotates so that the pressing contact portion moves in the same direction as the surface of a photoreceptor. In case that the pressing contact portion moves in the opposite direction, a toner removed by a brush roll may be spilled to contaminate a recording material or an apparatus when an excess toner is present on the surface of a photoreceptor.

When a photoreceptor and a brush roll move in a same direction as described above, the ratio of the both surface velocities is preferably a value within a range between 1 to 1.1 and 1 to 2. When a rotation velocity of a brush roll is slower than a photoreceptor, cleaning failure is liable to occur due to a reduced toner removing ability of a brush roll, while when it is faster than a photoreceptor, blade bounding or turn over is liable to occur due to an excess toner removing ability.

A surface energy-lowering agent refers to a material which adheres to the surface of a photoreceptor and lowers a surface energy, and specifically a material which increases a contact angle (a contact angle against pure water) of the surface of a photoreceptor by not less than 1° by adhering on the surface.

Measurement of Surface Contact Angle

A contact angle of a photoreceptor surface is measured against pure water by use of a contact angle meter (CA-DT·A type: produced by Kyowa Interface Science Co., Ltd.) under environment of 30° C. and 80% RH.

A surface energy-lowering agent includes a metal salt of fatty acid or a fluorine-contained resin, and these materials are liable to have large water content under conditions of high temperature and high humidity due to hydrophilic groups or impurity components in the materials. When the water content becomes large, the effects of the invention described above are hardly exhibited sufficiently because the surface energy-lowering agent is not uniformly plated on the surface of a photoreceptor. A surface energy-lowering agent utilized in the invention is able to exhibit the effects of the invention sufficiently, by having a water content of not more than 5 weight % under conditions of high temperature and high humidity of 30° C. and 80% RH.

Further, a surface energy-lowering agent is not limited to materials such as a metal salt of fatty acid or a fluoride-contained resin provided that a material increases a contact angle (a contact angle against pure water) of the surface of a photoreceptor by not less than 1°.

A surface energy-lowering agent utilized in the invention is preferably a metal salt of fatty acid as a material which has a spreading property and a film forming ability on the surface of a photoreceptor. A metal salt of fatty acid is preferably a metal salt of saturated or unsaturated fatty acid having not less than 10 carbon atoms. For example, such as aluminum stearate, indium stearate, gallium stearate, zinc stearate, lithium stearate, magnesium stearate, sodium stearate, aluminum palmitate and aluminum oleate are listed, and more preferable is a metal salt of stearic acid.

Among the metal salts of fatty acid described above, particularly a metal salt of fatty acid having a high effusion velocity of a flow tester is able to form a layer of a metal salt of fatty acid more effectively on the foregoing surface of the photoreceptor of the invention because of its high cleavage property. A range of an effusion velocity is preferably not less than $1\times10^{-7}$ and not more than $1\times10^{-1}$ and most preferably not less than $5\times10^{-4}$ and not more than $1\times10^{-2}$. An effusion velocity of a flow tester is measured by use of Shimadzu Flow Tester CFT-500 (produced by Shimadzu Corp.).

Further, as other examples of the solid material described above preferable are fluorine-contained resin powder such as polyvinylidene fluoride and polytetrafluoroethylene. These solid materials are preferably utilized by being made into a plate-shape or a bar-shape by applying pressure when necessary.

Herein, measurement of a water content is performed, in case of a surface energy-lowering agent, by charging the material in a shallow glass vessel and after being kept at 30° C. and 80% RH for 24 hours, by use of Karl Fischer's water content meter (produced by Kyoto Electronics Manufacturing Co., Ltd.; MKA-3p).

A method to make a water content of a surface energy-lowering agent not more than 5 weight % is achieved by decrease of a water content under a condition of high temperature and high humidity (30° C. and 80% RH) which is made possible by controlling hydrophilic components or impurities in the material, for example, by purification or hydrophobicity treatment; as well as by mixing of a water content controlling agent; or by high temperature drying treatment at not lower than 100° C. The water content described above is preferably from 0.01 to 5.0 weight % and more preferably from 0.05 to 3.0 weight %, to minimize dependence on environmental variation such as temperature rise during copying, particularly dependence on humidity of a set up place of an image carrying element, to make selection of materials and hydrophobicity treatment easy, and to prevent hollow characters and scattered characters.

The organic photoreceptor according to the invention is characterized in that the surface layer of the photoreceptor gives a specified plastic deformation property of not less than 1% and less than 3.5% when a specified load of 20 mN a pressure probe applying is applied to the surface of the organic photoreceptor by a pressing probe.

In an image forming method through an intermediate transferring member, a carrier having relatively small diameter is employed for development. The carrier with small diameter tends to damage the surface of a photoreceptor depending on the property of the photoreceptor.

The creeping modulus of the organic photoreceptor according to the invention is not less than 1% and less than 3.5%, and is preferably from 2.0% to 3.2%. When the creeping modulus is less than 1%, the surface of the photoreceptor is fragile and cracks are easily occurred by adhering of the carrier or rubbing by the blade so that black or white spots tend to be cyclically occurred.

Figure 7:
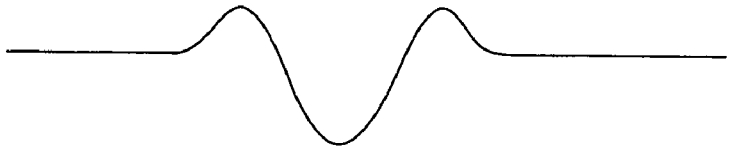
FIGS. 7(*a*) and (*b*) are each a schematic cross section showing damage formed on the photoreceptor.
Figure 7:
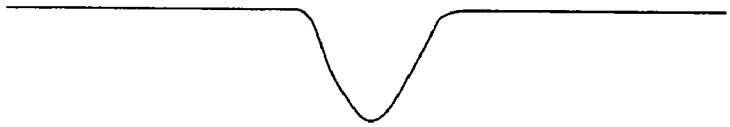

In the case of that the creeping modulus is not less than 3.5%, a dent is occurred and further a crater like damage having a raised portion at both sides thereof such as the cross section shown in FIG. 7(*a*) is occurred when the carrier is pressed to the photoreceptor surface. Such the damage destroys the cleaning blade of the photoreceptor and causes the insufficient cleaning and inflicts damage on the intermediate transferring member. Thus the line shaped image defect is occurred.

The damage formed on the photoreceptor is simple spot like dent such as that shown in FIG. 7(*b*); any bad influence on the cleaning blade caused by such the defect is almost not observed. The image defect only appears as only a very small spot.

Consequently, it is important in the image forming method employing the intermediate transferring member that the photoreceptor has suitable creeping modulus.

Figure 8:
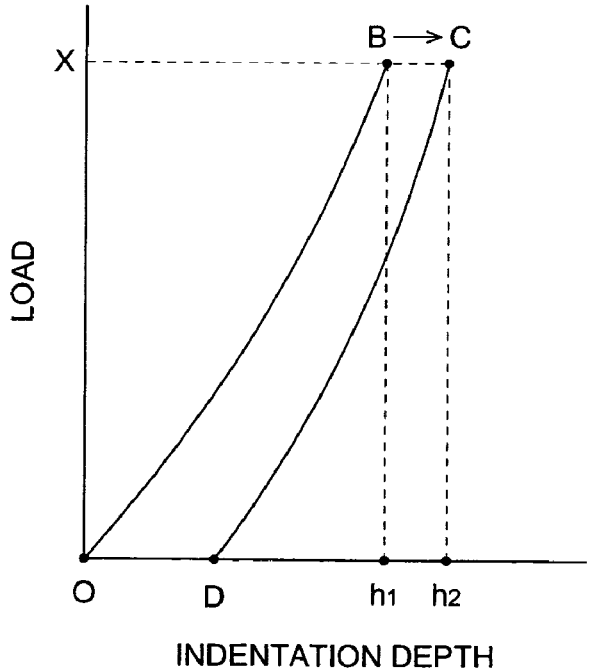
FIG. 8 shows a model of graph showing the relation of the load and the indentation depth for determining the creeping modulus.

The creeping modulus is also called as indentation viscoelastic modulus, and measurement method thereof is described in DIN 50359-1. FIG. 8 shows a model of measuring method, in which the load is taken on the ordinate and the indentation depth or the deformation amount is taken on the abscissa.

When the load is applied at a constant speed on the surface by the Vickers indenter, the indentation depth is increased from Point 0 to Point B. The indentation depth is increased as shown by Point C, where the indentation depth is h2, when the loading is retained for certain period after the load is reached to X at Point B where the indentation depth is h1. Thereafter, the load is reduced at a speed the same as that for loading, then the indentation depth is reduced and reached to Point D when the load is released. The indentation depth at Point D is called as permanent deformation even though the permanent deformation does not relate to the determination of the creeping modulus. The creeping modulus is calculated by $$(h2-h1)/h1\times 100(\%).$$

In the practical measurement, the load is applied for 5 minutes by a loading speed of 4 mN/second and the retaining period is 5 seconds.

In the image forming method according to the invention, the cleaning ability, and occurrence of cyclical damage and the interior lacking of the image are improved and the anti-damaging ability is strengthen and the stable surface is formed by employing the organic photoreceptor having the surface layer having the foregoing viscoelasticity, thus deformation of the toner image on the occasion of the development is not occurred and the electrophotographic image excellent in the sharpness can be formed.

The surface layer having the foregoing viscoelasticity can be realized by employing polycarbonate resin having high elasticity as binder and by constituting the surface layer by a charge transfer layer which has the high elasticity of the binder by using a charge transport substance having relatively high molecular weight. It is preferable that the charge transfer layer is constituted by two or more layers and the outermost layer has the foregoing constitution.

Examples of the polycarbonate resin having the high elasticity include the followings.

PC-1

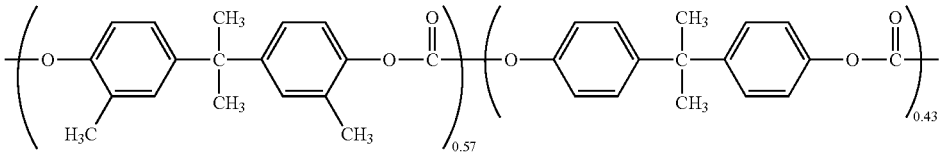

Mv = 27,000

PC-2

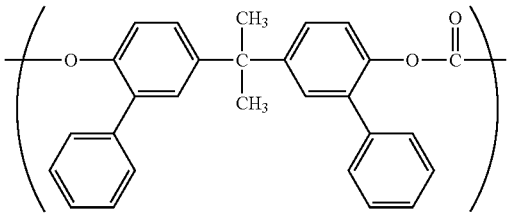

Mv = 32,000

PC-3

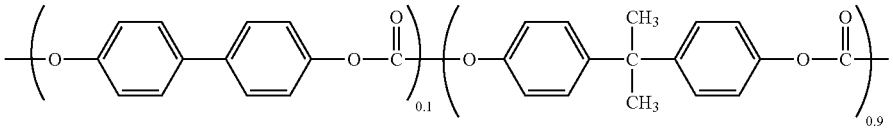

Mv = 31,000

In the above, Mv represents the viscosity average molecular weight.

The molecular weight of the charge transport substance is preferably from 500 to 1,500, and is more preferably from 600 to 1,000. Examples of the charge transport substance preferably employed in the invention include ones having the following chemical structures.

T-1

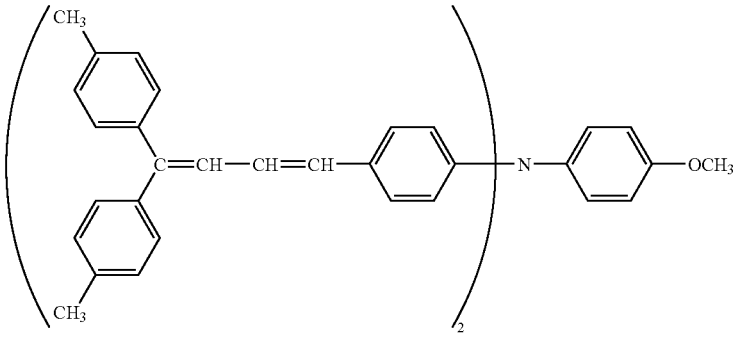

Mw = 739

T-2

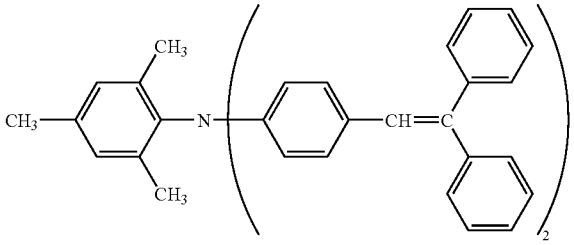

Mw = 643

T-3

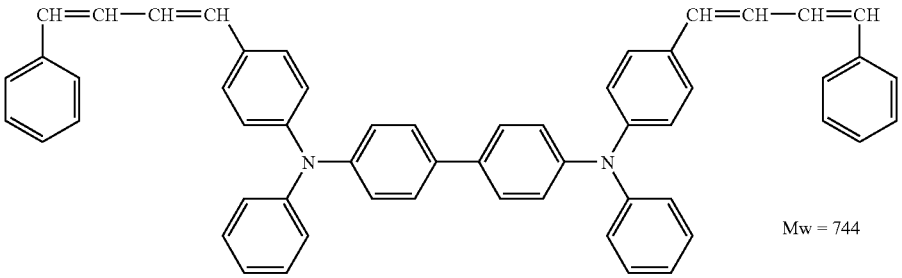

Mw = 744

In the above, Mw represents the molecular weight.

The mixing ratio of the foregoing high molecular weight charge transport substance and the polycarbonate resin is preferably from 0.5 to 3.0, and is more preferably from 0.8 to 2.0, parts per 1 part by weight of the charge transfer layer 1. However, the ratio is not absolute and is varied depending on the kind of the charge transport substance or the polycarbonate resin or on the presence of another additive.

The presence of hydrophobic inorganic particles having a number average primary particle diameter of 10 nm to 100 nm is preferred. The number average diameter of the hydrophobic inorganic particle is preferably from 10 nm to 90 nm, and is most preferably from 10 nm to 50 nm. When the number average primary diameter of the inorganic particles contained in the surface layer is less than 10 nm and not less than 100 nm, the foregoing viscoelasticity is difficultly obtained, consequently, the improving effect difficultly obtained. As the inorganic particle having the number average diameter of not less than 10 nm and less than 100 nm, micro particles of silica, zinc oxide, titanium oxide, tin oxide, antimony oxide, indium oxide, bismuth oxide, tin-doped indium oxide, antimony- or tantalum-doped tin oxide and zirconium oxide are preferably employed. Of these, silica, particularly hydrophobic silica hydrophobilized on the surface thereof, is preferred from the viewpoint of the cost and the facility of the diameter control and the surface treatment.

The number average primary particle diameter of the inorganic particles is defined by the number average of the fere diameter according to the image analyzing of 300 primary particles randomly selected from an electron microscopic image with a magnitude of 10,000.

The hydrophobicity of the hydrophobic silica is preferably not less than 50% in terms of hydrophobicity represented by methanol wetting ability. When the hydrophobicity is less than 50%, the endothermic energy variation ΔH tends to be larger than 10 j/g. Consequently, the environmental memory is easily formed and insufficient cleaning tends to be caused by the damage of the blade. The more preferable hydrophobicity is not less than 65%, and the most preferable hydrophobicity is not less than 70%.

$$SiCl_4+2H_2+O_2 \rightarrow SiO_2+4HCl$$

A compound micro powder of silica with another metal oxide can be obtained by employing in the production process another metal halide such as aluminum chloride and titanium chloride together with silicon halide.

The hydrophobilizing treatment of the silica powder can be performed by a dry treatment in which the micro powder of silica is dispersed in a cloud state by stirring and the alcohol solution of the hydrohobilizing agent is sprayed into the cloud or the evaporated hydrohobilizing agent is contacted with the cloud to be adhered to the silica, or a wet treatment in which the silica powder is dispersed in a medium and the hydrophobic agent is dropped into the dispersion to adhere the silica powder.

As the hydrophobilizing agent, known compounds may be employed, examples of which are shown below. These compounds may be employed in combination.

Listed as hydrophobicity providing agents are, for instance, titanium coupling agents such as tetrabutyl titanate, tetraoctyl titanate, isopropylisostearoyl titanate, isopropyltridecylbenzenesulfonyl titanate, bis(dioctylpyrophosphate) oxyacetate titanate, and the like.

Listed as silane coupling agents are (-(2-aminoethyl) aminopropyltrimethoxysilane, (-(2-aminoethyl)aminopropylmethydimethoxysilane, (-(methacryloxypropylmethoxysilane, N-(-(N-vinylbenzylaminoethyl) (-aminopropyltrimehtoxysilane hydrochloric acid salt, hexamethyldisilazane, methyltrimethoxysilane, butyltrimethoxysilane, isobutyltrimethoxysilane, hexyltriethoxysilane, hexyltrimethoxysilane, octyltrimethoxysilane, decyltrimethoxysilane, dodecytrimethoxysilane, phenyltrimethoxysilane, o-methylphenyltrimethoxysilane, p-methylphenyltrimethoxysilane, and the like.

Listed as silicone oil is dimethyl silicone oil, methylphenyl silicone oil, amino-modified silicone oil, and the like.

The hydrophobicity providing agents are preferably used in an amount of 1–40 weight %, more preferably 3–30 weight % based on the silica particles to cover the surface of the silica particles.

Hydrodienepolysiloxane compounds may be employed as the surface hydrophobilizing agent. The hydrodienepolysiloxane having a molecular weight of from 1,000 to 20,000 is usually available and shows satisfactory black spot preventing effect. Suitable effect can be obtained when methylhydrodienepolysilxane is used for the final surface treatment.

In the invention, the hydrophobic silica treated as above is contained in the surface layer of the organic photoreceptor together with the binder; the ratio of the silica in the surface layer to the binder is from 1 to 20%, more preferably from 2 to 15%, most preferably from 2 to 10, by weight. When the content is more than 20%, the endothermic energy variation $\Delta H$ is difficultly lowered to not more than 10 j/g and the environmental memory and the transfer ability of the toner tend to be lowered. On the other hand, when the content is less than 1%, insufficient cleaning and the lowering of the wear resistively tend to be lowered.

In the charge transport layer being the surface layer, a charge transport substance is contained additionally to the binder resin of the copolymerized carbonate and the hydrophobic inorganic particles. The content of the charge transport substance is preferably from 50 to 150% by weight of the binder resin. It is further preferable to add an antioxidant in an amount of from 1 to 10% of the binder resin.

The aforementioned physical property and the roughness of the surface layer can be realized by applying the above-mentioned constitution. The use the organic photoreceptor having such the surface layer improves the cleaning ability, the resistively to damage and wearing of the photoreceptor so that the electrophotographic image excellent in the sharpness extend over a prolonged period can be provided.

The constitution other than the surface layer of the organic photoreceptor to be employed in the invention is described.

In the invention, the organic photoreceptor is an electrophotographic photoreceptor containing an organic compound having at least one of functions of charge generation and charge transportation. The organic photoreceptor include a photoreceptor containing an organic charge generation substance or an charge transportation substance and that containing a polymer complex having the charge generation function and the charge transportation function.

The charge transportation layer is a layer for transporting the charge carrier generated in the charge generation layer by light exposure to the surface of the organic photoreceptor.

The organic photoreceptor according to the invention is basically constituted by the support and the charge generation layer and the charge transportation layer provided on the support. The most preferable constitution is to constitute the photosensitive layer by the charge generation layer and plural charge transportation layers in which the outermost layer contains the charge transportation substance, and to make the creeping modulus of the photoreceptor to not less than 1% and less than 3.5% when a Vickers indenter is pushed into the photoreceptor by the loading of 20 mN.

The component of the electrographic photoreceptor according to the invention is described below.

Electroconductive support

A cylindrical electroconductive support is preferably used to make compact the image forming apparatus even though a cylindrical and sheet-shaped support may either be used.

Images can be endlessly formed by the cylindrical electroconductive support. The electroconductive support having a straightness of not more than 0.1 mm and a swing width of not more than 0.1 mm is preferred.

A drum of metal such as aluminum or nickel, a plastic drum on the surface of which aluminum, tin oxide or indium oxide is provided by evaporation, and a plastic and paper drum each coated with an electroconductive substance may be used as the material. The specific electric resistively of the electroconductive support is preferably not more than $10^3$ Ωcm.

The electric conductive support having sealing processed alumite coating at the surface may be employed in the invention. The alumite processing is conducted in acidic bath such as chromic acid, oxalic acid, phosphoric acid, boric acid sulfamic acid etc., and anodic oxidation process in sulfuric acid provides most preferable result. Preferred condition for the anodic oxidation process in sulfuric acid is, for example, sulfuric acid content of 100 to 200 g/l, aluminum ion content of 1 to 10 g/l, bath temperature of around 20° C., and applying voltage of around 20 V. Thickness of the anodic oxidation coating is usually 20 μm or less, particularly 10 μm or less is preferable in average.

Interlayer

In the present invention, an interlayer, functioning as a barrier, may be provided between the electrically conductive support and the photosensitive layer.

In the invention, it is preferable in the interlayer that the titanium oxide is contained in the binder resin having small moisture absorption ratio. The average particle diameter, in terms of number average of primary particle diameter, of the titanium oxide is from 10 nm to 400 nm, and is preferably from 15 nm to 200 nm. The interlayer coating liquid employing the titanium oxide having the foregoing particle diameter is excellent in the dispersion stability and the interlayer formed by such the coating liquid is excellent in the black spot preventing ability and the environmental properties, and shows high anti-cracking property.

There are various kinds of the titanium oxide to be used in the invention each different in the shape thereof such as a branch-like, acicular-shaped and granule-shaped. The crystal type of the titanium oxide having such the shape includes an anatase type, a rutile type and an amorphous type. The titanium oxide having any of the crystal type may be used and two or more crystal type may be employed in combination. Of these, the granule shaped rutile type titanium oxide is most preferred.

It is preferable that the titanium oxide is one subjected to a surface treatment. In one of the surface treatments, the treatment is performed for plural times and the final one of the plural treatments is carried out by employing a reactive organic silicon compound. It is preferred that at least once of the treatment is carried out by at least one of alumina, silica and zirconia and the final treatment is carried out by the reactive organic silicon compound.

The alumina treatment, the silica treatment and the zirconia treatment are each the treatment for precipitating alumina, silica and zirconia on the surface of the titanium oxide, respectively. The alumina, silica and zirconia precipitated onto the surface each include the hydrated compound thereof, respectively. The surface treatment by the reactive organic silicon compound is a treatment employing the reactive organic silicon compound.

As above-mentioned, the surface of the titanium oxide particle is uniformly covered by applying at least twice surface treatments. When such the surface treated titanium oxide particles are employed in the interlayer, the stability of the titanium oxide particles dispersion in the interlayer and a good photoreceptor without occurring of the image defects such as the black spots can be obtained.

Examples of the reactive organic silicon compound include the compounds represented by the following Formula 1, but any compounds capable of reacting with the reactive group on the surface of the titanium oxide such as a hydroxyl group are usable.

General Formula (1)

$$(R)_n—Si—(X)_{4-n}$$

wherein R represents an organic group in which a carbon atom directly bonds to a silicon atom, X represents a hydroxyl group or a hydrolyzable group, and n represent an integer of 0 to 3.

In organic silicon compounds represented by General Formula (1), listed as organic groups represented by R, in which the carbon atom directly bonds to the silicon atom, are an alkyl group such as methyl, ethyl, propyl, butyl, and the like; an aryl group such as phenyl, tolyl, naphthyl, biphenyl, and the like; an epoxy containing group such as γ-glycidoxypropyl, β-(3,4-epoxycyclohexyl)ethyl, and the like; an acryloyl or methacryloyl containing group such as γ-acryloxypropyl, and γ-methacryloxypropyl; a hydroxy containing group such as γ-hydroxypropyl, 2,3-dihydroxypropyloxypropyl, and the like; a vinyl containing group such as vinyl, propenyl, and the like; a mercapto containing group such as γ-mercaptopropyl, and the like; an amino containing group such as γ-aminopropyl, N-β(aminoethyl)-γ-aminopropyl and the like; a halogen containing group such as γ-chloropropyl, 1,1,1-trifluoropropyl, nonafluorohexyl, perfluorooctylethyl and the like; and others such as a nitro- or cyano-substituted alkyl group. Specifically preferred are alkyl groups such as methyl, ethyl, propyl, butyl, and the like. Further, listed as hydrolizable groups represented by X are an alkoxy group such as methoxy, ethoxy, and the like, a halogen atom, and an acyloxy group.

Further, organic silicon compounds represented by General Formula (1) may be employed individually or in combinations of two or more types.

Further, in the specific organic silicon compounds represented by General Formula (1), when n is at least 2, a plurality of R may be the same or different. In the same manner, when n is not more than 2, a plurality of X may be the same or different. Still further, when at least two types of organic silicon compounds represented by General Formula (1) are employed, R and X, in each compound, may be the same or different.

The photosensitive layer of the function separated negatively charged photoreceptor is described below.

Charge Generation Layer

Charge generation layer: the charge generation layer contains one or more kinds of charge generation material CGM. Another material such as a binder resin and additive may be contains according to necessity.

Examples of usable CGM include a phthalocyanine pigment, an azo pigment, a perylene pigment and an azulenium pigment. These may be employed singly or in combination.

Employed as binders constituting said charge transporting layer may be any of several resins known in the art. Listed as preferred resins may be formal resins, butyral resins, silicone resins, silicone modified butyral resins, and phenoxy resins. The ratio of said binder resins to said CGMs is preferably from 20 to 600 weight parts with respect to 100 weight parts of the binder resins. The thickness of said CGL layer is preferably from 0.01 to 2 μm.

(Charge Transport Layer)

It is preferable that a charge transport layer is composed of a plurality of layers, outermost layer of which is a surface layer.

The charge transport layer comprises charge transport materials (CTM) as well as binders which disperse CTM and form a film. As to other materials, also incorporated may be additives such as antioxidants, if desired.

Employed as charge transfer materials (CTM) may be any of those known in the art. For example, it is possible to employ triphenylamine derivatives, hydrazone compounds, styryl compounds, benzidine compounds, and butadiene compounds. These charge transport materials are commonly dissolved in appropriate binder resins and are then subjected to film formation. Of these, CTMs, which are capable of minimizing the increase in residual potential under repeated use, are those which exhibit properties such as high mobility as well as an ionization potential difference of not more than 0.5 eV, and preferably not more than 0.30 eV from a combined CGM.

The ionization potential of CGM and CTM is determined employing Surface Analyzer AC-1 (manufactured by Riken Keiki Co.).

Cited as resins employed in the charge transport layer (CTL) are, for example, polystyrene, acrylic resins, methacrylic resins, vinyl chloride resins, vinyl acetate resins, polyvinyl butyral resins, epoxy resins, polyurethane resins, phenol resins, polyester resins, alkyd resins, polycarbonate resins, silicone resins, melamine resins, and copolymers comprising at least two repeating units of these resins, and other than these insulating resins, high molecular organic semiconductors, such as poly-N-vinylcarbazole. Polycarbonate resin is most preferable among these in view of small water absorbency, good dispersion of CTM and good electrophotographic property.

The ratio of binder resins to charge transport materials is preferably from 10 to 200 weight parts per 100 weight parts of the binder resins.

The thickness of the charge transport layer is preferably from 10 to 40 μm.

Listed as solvents or dispersion media which are employed to form layers such as interlayers, photosensitive layers, and protective layers, are n-butylamine, diethylamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dicholorethane, 1,2-dichloropropane, 1,1,2-trichloroethane, 1,1,1-trichloroethane, trichloroethylene, tetrachloroethane, tetrahydrofuran, dioxysolan, dioxane, methanol, ethanol, butanol, isopropanol, ethyl acetate, butyl acetate, dimethyl sulfoxide, methyl cellosolve, and the like. However, the present invention is not limited to these examples, and also preferably employed are dichloromethane, 1,2-dicholorethane, methyl ethyl ketone, and the like. Further, these solvents may be employed individually or in combination as a solvent mixture of two or more types.

A coating method such as a dipping method, a spray coating method and a coating method by a round shaped amount controlling coating means is applicable. The spray coating method and the coating method by the round shaped amount controlling coating means such as a round slide hopper are preferable for inhibiting dissolution of the lower layer on the occasion of coating of the upper layer and for attaining uniform coating. The use of the coating method by the round shaped amount controlling coating means is most preferable for coating of the protective layer. The coating method by the round shaped amount controlling coating means is described in detail in, for example, JP O.P.I. No. 58-189061.

Developer

When the toner of the present invention is employed in the non-contact development method, it is preferably employed as a two-component developer material while mixing with the carrier.

Employed as carriers constituting the two-component developer material, may be materials which are conventionally known in the art, such as metals, e.g., iron, ferrite, magnetite, and the like, and alloys of said metals with metals such as aluminum, lead, and the like, as magnetic particles. Specifically, ferrite particles are preferred. The volume average particle diameter of said magnetic particles is preferably between 15 and 100 (m, and is more preferably between 25 and 60 (m. The volume average particle diameter of carrier may be measured employing a laser diffraction type particle size distribution measuring device, HELOS·(manufactured by SYNPATEC Co.) equipped with a wet-type homogenizer as a representative device.

Preferred carriers are those which are further coated with a resin or a so-called resin-dispersed type carrier prepared by dispersing magnetic particles into a resin. Resin compositions for coating are not particularly limited. For example, employed may be olefin based resins, styrene based resins, styrene/acryl based resins, silicone based resins, ester based resins, fluorine containing polymer based resins, and the like. Furthermore, resins to constitute the resin-dispersed type carrier are also not particularly limited, and those known in the art may be employed. For example, employed may be styrene acrylic resins, polyester resins, fluorine based resins, phenol resins, and the like.

Though the toner may be produced employing processes such as pulverization and classification, or employing a so-called polymerization method in which toner is prepared employing resinous particles prepared by a polymerization method, the toner particles preferably have uniform shape coefficient and particle size distribution described later. Such toner can form an image having high contrast and high sharpness used with the image forming method of this invention.

(1) The Toner Having a Number Ratio of Toner Particles Having a Shape Coefficient of 1.2 to 1.6 is At Least 65 Percent The toner particles having a shape coefficient of not more than 1.2 have round shapes closed to sphere, and have strong adhesion to a photoreceptor, whereby tend to produce cleaning deficiency. When the shape coefficient is more than 1.6, toner particles are easy to pulverized to produce fine powder, whereby tend to produce cleaning deficiency. The toner of which a number ratio of toner particles having a shape coefficient of 1.2 to 1.6 is at least 65 percent, preferably 70%, it is possible to obtain high image quality over an extended time of period, which exhibits excellent cleaning properties, as well as excellent image reproduction.

(2) The Toner Having the Number Ratio of Toner Particles, Having No Corners, is Set At 50 Percent The toner particles of the present invention, which substantially have no corners, as described herein, mean those having no projection to which charges are concentrated or which tend to be worn down by stress. It is possible to obtain high image quality over an extended time of period, which exhibits excellent cleaning properties, as well as excellent fine line reproduction by employing a toner in which the number ratio of toner particles, having no corners, is set at 50 percent, more preferably 70%.

(3) The Toner Having a Sum M of At Least 70 Percent.

The toner of the present invention preferably has a sum M of at least 70 percent. Said sum M is obtained by adding relative frequency m1 of toner particles, included in the most frequent class, to relative frequency m2 of toner particles included in the second frequent class in a histogram showing the particle diameter distribution, which is drawn in such a manner that natural logarithm lnD is used as an abscissa, wherein D (in μm) represents the particle diameter of a toner particle, while being divided into a plurality of classes at intervals of 0.23, and the number of particles is used as an ordinate.

(4) The Toner Having a Variation Coefficient of the Toner Shape Coefficient of Not More than 16 Percent and Having a Number Variation Coefficient of 27% or Less The toner having a variation coefficient of the toner shape coefficient of not more than 16 percent, as well as having a number variation coefficient of 27% or less is preferably employed because high image quality, which is exhibited by excellent cleaning properties, as well as excellent fine line reproduction, can be obtained over an extended period of time.

The number variation coefficient is 27% or less, and preferably 25% or less. The variation coefficient of the toner shape coefficient of not more than 16 percent, and preferably not more than 14%. A high image quality, which is exhibited by excellent cleaning properties, as well as excellent fine line reproduction, can be obtained over an extended period of time by employing toner having such characteristics.

The toner of which a number ratio of toner particles having a shape coefficient of 1.2 to 1.6 is at least 65 percent, and further the variation coefficient of said shape coefficient is not more than 16 percent, it is possible to obtain high image quality over an extended time of period, which exhibits excellent cleaning properties, as well as excellent fine line reproduction.

The toner in which the number ratio of toner particles, having no corners, is not less than 50 percent and having a number variation coefficient of 27% or less can produce high quality image, which is exhibited by excellent cleaning properties, as well as excellent fine line reproduction, over an extended period of time.

The number average particle diameter of the toner is preferably from 3 to 8 μm. The average particle diameter can be controlled by concentration of a coagulant, amount of an organic solvent, fusing period, or further composition of polymer in case that the toner is prepared by polymerization method.

By adjusting the number average particle diameter from 3 to 8 μm, it is possible to decrease the presence of toner and the like which is adhered excessively to the developer conveying member or exhibits low adhesion, and thus stabilize developability over an extended period of time. At the same time, improved is the halftone image quality as well as general image quality of fine lines, dots, and the like.

The shape coefficient of the toner particles of the present invention is expressed by the formula described below and represents the roundness of toner particles.

$$\text{Shape coefficient}=[(\text{maximum diameter}/2)^2\times\pi]/\text{projection area}$$

wherein the maximum diameter means the maximum width of a toner particle obtained by forming two parallel lines between the projection image of said particle on a plane, while the projection area means the area of the projected image of said toner on a plane.

In the present invention, said shape coefficient was determined in such a manner that toner particles were photographed under a magnification factor of 2,000, employing a scanning type electron microscope, and the resultant photographs were analyzed employing "Scanning Image Analyzer", manufactured by JEOL Ltd. At that time, 100 toner particles were employed and the shape coefficient of the present invention was obtained employing the aforementioned calculation formula.

The toner of which a number ratio of toner particles having a shape coefficient of 1.2 to 1.6 is at least 65 percent, more preferably at least 70 percent.

The shape coefficient can be controlled by a method in which, for example, toner particles are sprayed in heat stream, toner particles are subjected to mechanical energy by impact force in a gas phase repeatedly, or toner is added to a solvent which does not dissolve the toner and is subjected to spinning stream. It is preferable to prepare the toner having the shape coefficient by using polymerization method toner.

The variation coefficient of the polymerized toner is calculated using the formula described below:

$$\text{Variation coefficient}=(S/K)\times 100\ \text{(in percent)}$$

wherein S represents the standard deviation of the shape coefficient of 100 toner particles and K represents the average of said shape coefficient.

Said variation coefficient of the shape coefficient is generally not more than 16 percent, and is preferably not more than 14 percent. Voids in toner decreases, fixing ability is improved and off-setting is depressed. Further, charging distribution becomes sharp whereby an image quality is improved.

In order to control said shape coefficient of toner uniformly as well as the variation coefficient of the shape coefficient with minimal fluctuation of production lots, the optimal finishing time of processes may be determined while monitoring the properties of forming toner particles (colored particles) during processes of polymerization, fusion, and shape control of resinous particles (polymer particles).

Monitoring as described herein means that measurement devices are installed in-line, and process conditions are controlled based on measurement results. Namely, a shape measurement device, and the like, is installed in-line. For example, in a polymerization method, toner, which is formed employing association or fusion of resinous particles in water-based media, during processes such as fusion, the shape as well as the particle diameters, is measured while sampling is successively carried out, and the reaction is terminated when the desired shape is obtained.

Monitoring as described herein means that measurement devices are installed in-line, and process conditions are controlled based on measurement results. Namely, a shape measurement device, and the like, is installed in-line. For example, in a polymerization method, toner, which is formed employing association or fusion of resinous particles in water-based media, during processes such as fusion, the shape as well as the particle diameters, is measured while sampling is successively carried out, and the reaction is terminated when the desired shape is obtained.

Monitoring methods are not particularly limited, but it is possible to use a flow system particle image analyzer FPIA-2000 (manufactured by Toa Medical Electronics Co., Ltd). Said analyzer is suitable because it is possible to monitor the shape upon carrying out image processing in real time, while passing through a sample composition. Namely, monitoring is always carried out while running said sample composition from the reaction location employing a pump and the like, and the shape and the like are measured. The reaction is terminated when the desired shape and the like is obtained.

The number particle distribution as well as the number variation coefficient of the toner of the present invention is measured employing a Coulter Counter TA-11 or a Coulter Multisizer (both manufactured by Coulter Co.). In the present invention, employed was the Coulter Multisizer which was connected to an interface which outputs the particle size distribution (manufactured by Nikkaki), as well as on a personal computer. Employed as used in said Multisizer was one of a 100 μm aperture. The volume and the number of particles having a diameter of at least 2 μm were measured and the size distribution as well as the average particle diameter was calculated. The number particle distribution, as described herein, represents the relative frequency of toner particles with respect to the particle diameter, and the number average particle diameter as described herein expresses the median diameter in the number particle size distribution.

The number variation coefficient in the number particle distribution of toner is calculated employing the formula described below:

$$\text{Number variation coefficient}=(S/D_n)\times 100\ \text{(in percent)}$$

wherein S represents the standard deviation in the number particle size distribution and $D_n$ represents the number average particle diameter (in μm).

Methods to control the number variation coefficient of the present invention are not particularly limited. For example, employed may be a method in which toner particles are classified employing forced air. However, in order to further decrease the number variation coefficient, classification in liquid is also effective. In said method, by which classification is carried out in a liquid, is one employing a centrifuge so that toner particles are classified in accordance with differences in sedimentation velocity due to differences in the diameter of toner particles, while controlling the frequency of rotation.

Specifically, when a toner is produced employing a suspension polymerization method, in order to adjust the number variation coefficient in the number particle size distribution to not more than 27 percent, a classifying operation may be employed. In the suspension polymerization method, it is preferred that prior to polymerization, polymerizable monomers be dispersed into a water based medium to form oil droplets having the desired size of the toner. Namely, large oil droplets of said polymerizable monomers are subjected to repeated mechanical shearing employing a homomixer, a homogenizer, and the like to decrease the size of oil droplets to approximately the same size of the toner. However, when employing such a mechanical shearing method, the resultant number particle size distribution is broadened. Accordingly, the particle size distribution of the toner, which is obtained by polymerizing the resultant oil droplets, is also broadened. Therefore classifying operation may be employed.

The toner particles of the present invention, which substantially have no corners, as described herein, mean those having no projection to which charges are concentrated or which tend to be worn down by stress. Namely, as shown in FIG. 6(*a*), the main axis of toner particle T is designated as L. Circle C having a radius of L/10, which is positioned in toner T, is rolled along the periphery of toner T, while remaining in contact with the circumference at any point. When it is possible to roll any part of said circle without substantially crossing over the circumference of toner T, a toner is designated as "a toner having no corners". "Without substantially crossing over the circumference" as described herein means that there is at most one projection at which any part of the rolled circle crosses over the circumference. Further, "the main axis of a toner particle" as described herein means the maximum width of said toner particle when the projection image of said toner particle onto a flat plane is placed between two parallel lines. Incidentally, FIGS. 6(*b*) and 6(*c*) show the projection images of a toner particle having corners.

Toner having no corners was measured as follows. First, an image of a magnified toner particle was made employing a scanning type electron microscope. The resultant picture of the toner particle was further magnified to obtain a photographic image at a magnification factor of 15,000. Subsequently, employing the resultant photographic image, the presence and absence of said corners was determined. Said measurement was carried out for 100 toner particles.

Methods to obtain toner having no corners are not particularly limited. For example, as previously described as the method to control the shape coefficient, it is possible to obtain toner having no corners by employing a method in which toner particles are sprayed into a heated air current, a method in which toner particles are subjected to application of repeated mechanical force, employing impact force in a gas phase, or a method in which a toner is added to a solvent which does not dissolve said toner and which is then subjected to application of revolving current. Polymerization toner prepared by polymerization is preferable in view of preparation cost and energy cost.

Further, in a polymerized toner which is formed by associating or fusing resinous particles, during the fusion terminating stage, the fused particle surface is markedly uneven and has not been smoothed. However, by optimizing conditions such as temperature, rotation frequency of impeller, the stirring time, and the like, during the shape controlling process, toner particles having no corners can be obtained. These conditions vary depending on the physical properties of the resinous particles. For example, by setting the temperature higher than the glass transition point of said resinous particles, as well as employing a higher rotation frequency, the surface is smoothed. Thus it is possible to form toner particles having no corners.

The diameter of toner particles is designated as D (in μm). In a number based histogram, in which natural logarithm lnD is taken as the abscissa and said abscissa is divided into a plurality of classes at an interval of 0.23, a toner is preferred, which exhibits at least 70 percent of the sum (M) of the relative frequency ($m_1$) of toner particles included in the highest frequency class, and the relative frequency ($m_2$) of toner particles included in the second highest frequency class.

By adjusting the sum (M) of the relative frequency ($m_1$) and the relative frequency ($m_2$) to at least 70 percent, the dispersion of the resultant toner particle size distribution narrows. Thus, by employing said toner in an image forming process, it is possible to securely minimize the generation of selective development.

In the present invention, the histogram, which shows said number based particle size distribution, is one in which natural logarithm lnD (wherein D represents the diameter of each toner particle) is divided into a plurality of classes at an interval of 0.23 (0 to 0.23, 0.23 to 0.46, 0.46 to 0.69, 0.69 to 0.92, 0.92 to 1.15, 1.15 to 1.38, 1.38 to 1.61, 1.61 to 1.84, 1.84 to 2.07, 2.07 to 2.30, 2.30 to 2.53, 2.53 to 2.76 . . . ). Said histogram is drawn by a particle size distribution analyzing program in a computer through transferring to said computer via the I/O unit particle diameter data of a sample which are measured employing a Coulter Multisizer under the conditions described below.

(Measurement Conditions)

(1) Aperture: 100 μm (2) Method for preparing samples: an appropriate amount of a surface active agent (a neutral detergent) is added while stirring in 50 to 100 ml of an electrolyte, ISOTON R-11 (manufactured by Coulter Scientific Japan Co.) and 10 to 20 ml of a sample to be measured is added to the resultant mixture. Preparation is then carried out by dispersing the resultant mixture for one minute employing an ultrasonic homogenizer.

Preparation by polymerization method is preferable among the method controlling shape coefficient since it is simple and excellent in uniformity of surface in comparison with pulverization toner.

It is possible to prepare the toner of the present invention in such a manner that fine polymerized particles are produced employing a suspension polymerizing method, and emulsion polymerization of monomers in a liquid added with an emulsion of necessary additives is carried out, and thereafter, association is carried out by adding organic solvents, coagulants, and the like. Methods are listed in which during association, preparation is carried out by associating upon mixing dispersions of releasing agents, colorants, and the like which are required for constituting a toner, a method in which emulsion polymerization is carried out upon dispersing toner constituting components such as releasing agents, colorants, and the like in monomers, and the like. Association as described herein means that a plurality of resinous particles and colorant particles are fused.

An example of preparation method of the toner particles is described. Namely, added to the polymerizable monomers are colorants, and if desired, releasing agent, charge control agents, and further, various types of components such as polymerization initiators, and in addition, various components are dissolved in or dispersed into the polymerizable monomers employing a homogenizer, a sand mill, a sand grinder, an ultrasonic homogenizer, and the like. The polymerizable monomers in which various components have been dissolved or dispersed are dispersed into a water based medium to obtain oil droplets having the desired size of a toner, employing a homomixer, a homogenizer, and the like. Thereafter, the resultant dispersion is conveyed to a reaction apparatus which utilizes stirring blades described below as the stirring mechanism and undergoes polymerization reaction upon heating. After completing the reaction, the dispersion stabilizers are removed, filtered, washed, and subsequently dried. In this manner, the toner of the present invention is prepared.

The toner of the invention can be prepared by a method in which resin particles are associated or fused in a water based medium. The water based medium as described in the present invention means one in which at least 50 percent, by weight of water, is incorporated. A method for preparing said toner may includes one in which resinous particles are associated, or fused, in a water based medium. Said method is not particularly limited but it is possible to list, for example, methods described in JP-A Nos. 5-265252, 6-329947, and 9-15904. Namely, it is possible to form the toner of the present invention by employing a method in which at least two of the dispersion particles of components such as resinous particles, colorants, and the like, or fine particles, comprised of resins, colorants, and the like, are associated, specifically in such a manner that after dispersing these in water employing emulsifying agents, the resultant dispersion is salted out by adding coagulants having a concentration of at least the critical coagulating concentration, and simultaneously the formed polymer itself is heat-fused at a temperature higher than the glass transition temperature, and then while forming said fused particles, the particle diameter is allowed gradually to grow; when the particle diameter reaches the desired value, particle growth is stopped by adding a relatively large amount of water; the resultant particle surface is smoothed while being further heated and stirred, to control the shape and the resultant particles which incorporate water, is again heated and dried in a fluid state. Further, herein, organic solvents, which are infinitely soluble in water, may be simultaneously added together with said coagulants.

Materials, polymerization methods, reaction apparatuses for the preparation of polymerization toner and so on to prepare a toner having uniform characteristics such as shape coefficient are described in JP A-2000-214629.

EXAMPLES

The invention will now be detailed with reference to examples.

EXAMPLES

Preparation of Photoreceptor 1

Photoreceptor 1 was prepared as follows.

The surface of a cylindrical aluminum substrate was shaved to prepare an electroconductive substrate having a surface roughness Rz of 1.5 μm.

<Interlayer>

The following dispersion liquid for interlayer was diluted by 2 times by a mixed solvent the same as in the following, and then stood for 24 hours and filtered through Rigimesh 5 μm filter produced by Nihon Pall Co., Ltd. to prepare an interlayer coating liquid.

| | |
|---|---|
| Polyamide resin (CM800: Toray Co., Ltd.) | 1 part |
| Titanium oxide (SMT500SAS: TAYCA CORPORATION) | 3 parts |
| Methanol | 10 parts |

The mixture was dispersed for 10 minutes by a sand mill according to a batch method.

The above-prepared coating liquid was coated on the aforementioned substrate so that the dry thickness of the coated layer was 2 μm.

<Charge Generation Layer>

| | |
|---|---|
| Charge generation substance: Titanylphthalocyanine pigment* | 20 parts |
| Poly(vinyl butyral) resin (#6000-C: Denki Kagaku Kogyo Co., Ltd.) | 10 parts |
| t-butyl acetate | 700 parts |
| 4-methoxy-4-methyl-2-pentanone | 300 parts |

*Titanylphthalocyanine pigment having the maximum peak of the Cu—Kα X-ray diffraction spectrum at Blag angle 2θ (±0.2) of 27°

The above mixture was dispersed by a sand mill for 10 minutes to prepare a charge generation layer coating liquid. The coating liquid was coated on the aforementioned interlayer by a dipping coating method. Thus a charge generation layer having a dry thickness of 0.3μm was formed.

<First Charge Transportation Layer>

| | |
|---|---|
| Charge transportation substance T-1 | 200 parts |
| Polycarbonate resin (PC-1: Mitsubishi Gas Kagaku Co., Ltd.) | 300 parts |
| Antioxidant (Irganox1010: Nihon Ciba-Geigy Co., Ltd.) | 6 parts |
| Dichloromethane | 2000 parts |
| Silicone oil (KF-54: Shin'Etsu Kagaku Co., Ltd.) | 1 part |

The above-mentioned were mixed and dissolved to prepare a charge transportation coating liquid was prepared. The coating liquid was coated on the above-prepared charge generation layer by a dipping coating method to form the first charge transportation layer having a dry thickness of 15 μm.

| | |
|---|---|
| Charge transportation substance T-1 | 20 parts |
| Polycarbonate resin (PC-1: Mitsubishi Gas Kagaku Co., Ltd.) | 30 parts |
| Hydrophobic silica, average primary particle diameter: 40 nm, hexylmethyldisilazne, hydrophobic degree: 76% | 3.0 parts |
| Antioxidant (LS2626: Sankyo Co., Ltd.) | 0.6 parts |
| 1,3-dioxorane | 600 parts |
| Silicone oil (KF-54: Shin'Etsu Kagaku Co., Ltd.) | 0.1 parts |

<Second Charge Transportation Layer: Surface Layer>

The above-mentioned were mixed and dispersed by circulation dispersing apparatus having an ultrasonic wave irradiation means to prepare the second charge transportation layer coating liquid. The coating liquid was coated on the first charge transportation layer by a circular coating amount controlling coating apparatus to form a second charge transportation layer having a dry thickness of 5μm. The coated layer was dried for 70 minutes at 110° C. to prepare Photoreceptor 1.

Preparation of Photoreceptors 2 through 7

Photoreceptors 2 through 7 were prepared in the same manner as in Photoreceptor 1 except that the kind and amount of the charge transportation substance and the polycarbonate resin in the second charge transportation layer were changed as shown in Table 1.

Preparation of Photoreceptor 8

Photoreceptor 8 was prepared in the same manner as in Photoreceptor 1 except that the dry thickness of the first charge transportation layer was changed to 20 μm and the second charge transportation layer was omitted.

TABLE 1

| | Second charge transportation layer | | | | |
|---|---|---|---|---|---|
| Photo-receptor No. | Charge transpor-tation substance (kind) | Amount (part) | Poly-carbonate resin | Creeping ratio (%) | Remarks |
| 1 | T-1 | 20 | PC-1 | 2.2 | Inventive |
| 2 | T-1 | 20 | PC-2 | 1.6 | Inventive |
| 3 | T-2 | 20 | PC-1 | 3.3 | Inventive |
| 4 | T-3 | 20 | PC-1 | 1.2 | Inventive |
| 5 | T-4 | 20 | PC-4 | 4.2 | Comparative |
| 6 | T-1 | 40 | PC-2 | 0.9 | Comparative |
| 7 | T-2 | 20 | PC-3 | 1.8 | Inventive |
| 8 | — | — | — | 2.5 | Inventive |

The creeping modulus shown in Table 1 was measured as follows.

Measurement of the Creeping Modulus

Apparatus: Fischer Scope H100V (hardness meter for microscopic area) manufacture by Fischer Instruments Co., Ltd.

Probe: Diamond Vickers Pressure Probe

Loading condition; The Vickers pressure probe was pushed into the surface of the organic photoreceptor at a speed of 4 mN/second.

Loading Period: 5 seconds

Load Retention Period: 5 second

Load releasing condition: The loading was released at the same speed as the loading.

Sample for measurement: Samples for measurement were each prepared by providing and drying an interlayer, charge generation layer, first charge transportation layer and second charge transportation layer each the same as those in the above-mentioned photoreceptor, respectively, on a aluminum plate. Thus prepared sample was fixed on the Fischer Scope H100V and the Vickers pressure prove is perpendicularly pushed into the sample.

The measurement was carried out by the procedure of loading for 5 seconds, load retention for 5 seconds and load releasing. The creeping modulus was the ratio of the deformation during the load retention period.

Calculation of Creeping Modulus $$\text{Creeping ratio CHU}=\{(h2-h1)/h1\}\times 100\%$$

In the above, h1 is the indentation depth at the time when the loading is reached to 20 mN, 5 minutes after the start of the load application, and h2 is the indentation depth after the retention of load for 5 minutes.

The chemical structure of the charge transportation substance T-4 and that of the polycarbonate resin PC-4 described in Table 1 are shown below. In the followings, Mv is viscosity average molecular weight and Mw is molecular weight.

PC-4

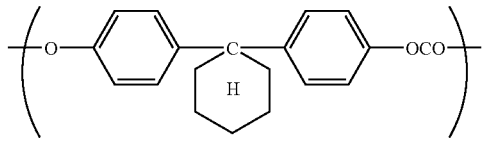

Mw = 30,000

T-4

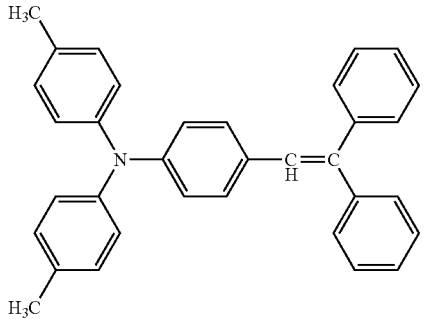

Mw = 451

Preparation of Intermediate Transferring Member

Endless belts of silicone rubber containing carbon black which have a volume resistively of $1\times10^{8}$ Ω·cm were used. The surface roughness Rz of each of the belts was changed to 0.5, 1.0 or 1.8 μm. Thus 3 kinds of intermediate transferring member were prepared.

<Evaluation>

The cleaning device shown in FIG. 5 was installed in the digital color printer shown in FIG. 1 as the cleaning means for the photoreceptor. In the printer, a stick of zinc stearate with a moisture content of 1% was pressed to the cleaning brush so that the zinc stearate is supplied to the photoreceptor surface. In the printer, the photoreceptor, intermediate transferring member and the inroad depth into the brush were set in the combination as shown in table 2. An original image, in which a character image having an image ratio of 8% and a halftone image were mingled with together, was continuously copied on 20,000 sheets of A4 size paper under a high temperature and high humid condition at 30° C. and 80% RH. Thus printed image were subjected to evaluation. The items and the norms of the evaluation are shown below. The results of the evaluation are shown in Table 2.

Items and norms of the evaluation Rz of the intermediate member was evaluated by aforementioned method.

<Cleaning Property>

Occurrence of passing through the cleaning blade of the toner caused by wearing of the cleaning blade and the photoreceptor was evaluated.

A: Passing of toner was not occurred until 20,000 sheets of print.

B: Passing of toner was not occurred until 10,000 sheets of print.

C: Passing of toner was occurred before 10,000 sheets of print; such the level caused a problem on practical use.

<Occurrence of Line-shaped Defects>

A: No black or colored line-shaped defect was occurred until 20,000 sheets of print.

B: No black or colored line-shaped defect was occurred until 10,000 sheets of print.

C: Black or colored line-shaped defects were occurred before 10,000 sheets of print; such the level caused a problem on practical use.

<Interior Lacking of Image>

The character images were enlarged and the occurrence of the interior lacking of the image was visually observed.

Evaluation was carried out according to the following norm.

A: Apparent occurrence of the interior lacking was not observed until 20,000 sheets of print.

B: Apparent occurrence of the interior lacking was not observed until 10,000 sheets of print.

C: Apparent occurrence of the interior lacking was observed before 10,000 sheets of print; such the level caused a problem on practical use.

<Cyclic Image Defects>

Crack damages were formed on the surface of the photoreceptor by adhesion of the carrier and image defects such as black or white spots were occurred corresponding to the rotation cycle of the photoreceptor. Evaluation was carried out according to the following norm.

A: No cyclic image defect was occurred until 20,000 sheets of print.

B: No cyclic image defect was occurred until 10,000 sheets of print.

C: Cyclic image defects were occurred before 10,000 sheets of print; such the level caused a problem on practical use.

<Evaluation of Image Quality>

After print of 20,000 sheets, the character image and the halftone image were visually observed.

Results of the visual evaluation are shown in Table 2. Evaluation condition other than the above-mentioned Line speed of image formation L/S: 180 mm/s Charging condition of photoreceptor: The potential at the non-image area was detected by a potential sensor so that the potential can be controlled. The controllable range was −500 V through −900 V and the surface potential of the photoreceptor after fully exposure was within the range of from −50 V to 0V.

Light for imagewise exposure: Semiconductor laser, wavelength: 780 nm.

Developing condition: The yellow, magenta, cyan and black developer were all 2-component developer each comprised of a polymerized toner having a number average diameter of 7.5 μm and mainly composed of acryl resin and a pigment and a carrier composed of ferrite core particles having an average diameter of 45 μm covered with an isolative resin. The developing device is suited for the development by the 2-compounent. The Y, M, C and K toners all satisfied the following conditions: the toner particles each having a shape coefficient of 1.2 through 1.6 accounted for 65% or more in number; the toner particles having no corner accounted for 50% or more in number; the sum M of the relative frequency $m_1$ of the toner particles included in the highest frequency group and the relative frequency $m_2$ of the toner particles included in the subsequently higher frequency group was not less than 70%; the variation coefficient of number in the number particle size distribution was not more than 27%; and the variation coefficient of the particle shape was not more than 16%. The development was reversal development.

Intermediate transferring member: the aforementioned seamless endless belt type intermediate transferring member was employed.

Primary Transfer Condition

The primary transfer rollers (5Y, 5M, 5C and 5K in FIG. 1 each having a diameter of 6.05 mm) constituted by a core metal roller covered with elastic rubber, specific surface resistively: $1\times10^6$ Ω, the transferring surface pressure was changed as shown in Table 2.

Secondary Transferring Condition

A backup roller 74 and a secondary transferring roller 5A are provided on both sides of the endless intermediate transferring belt. The resistively of the backup roller 74 was $1\times10^6$ Ω, and the resistively of the secondary transferring roller was $1\times10^6$ Ω and the electric current to the roller was controlled by constant current control so as to be 80 μA.

The fixing was performed by a heat fixing method employing a fixing roller in which a heater was provided.

The distance Y from the first contact point of the intermediate transferring member and the photoreceptor to the first contact point of the intermediate transferring member to the next color photoreceptor was 95 mm.

The circumference length of driving roller 71, guide rollers 72 and 73 and backup roller 74 for the secondary transfer were each 31.67 mm (=93 mm/3) and the circumference length of tension roller 76 was 23.75 (=93 mm/4).

The circumference length of the primary transferring roller was 19 mm (=95 mm/5).

Cleaning Means for Photoreceptor

Cleaning blade: elastic rubber

Cleaning brush: electroconductive acryl resin, hair density of the brush: $3\times10^3/cm^2$, the inroad depth into the brush was changed to 0.6, 1.0 or 1.3 mm.

The secondary transferring roller (5A in FIG. 1): a metal core covered with elastic rubber; transferring voltage was applied to the roller.

Cleaning Means for the Intermediate Transferring Member

Cleaning blade: elastic rubber

Cleaning roller

TABLE 2

| Combination No. | Photoreceptor No. | *1 | *2 | *3 | *4 | *5 | *6 | *7 | *8 | Image quality evaluation | Remarks |
|---|---|---|---|---|---|---|---|---|---|---|---|
| 1 | 1 | 0.15 | 50 | 1.0 | 1.0 | A | A | A | A | *9 | Inv. |
| 2 | 1 | 0.25 | 50 | 1.0 | 1.0 | A | A | A | A | *9 | Inv. |
| 3 | 1 | 0.15 | 70 | 1.0 | 1.0 | A | A | A | A | *9 | Inv. |
| 4 | 1 | 0.40 | 50 | 0.5 | 1.0 | A | A | A | A | *9 | Inv. |
| 5 | 1 | 0.15 | 50 | 1.8 | 1.0 | A | A | B | B | *9 | Inv. |
| 6 | 1 | 0.15 | 50 | 1.0 | 0.6 | A | A | B | B | *9 | Inv. |
| 7 | 1 | 0.15 | 50 | 1.0 | 1.3 | A | B | A | A | *9 | Inv. |
| 8 | 2 | 0.15 | 50 | 1.0 | 1.0 | A | A | A | B | *9 | Inv. |
| 9 | 3 | 0.15 | 50 | 1.0 | 1.0 | B | B | A | A | *9 | Inv. |
| 10 | 4 | 0.15 | 50 | 1.0 | 1.0 | A | A | A | B | *9 | Inv. |
| 11 | 5 | 0.15 | 50 | 1.0 | 1.0 | C | C | B | B | *10 | Comp. |
| 12 | 6 | 0.15 | 50 | 1.0 | 1.0 | B | B | C | C | *11 | Comp. |
| 13 | 7 | 0.15 | 50 | 1.0 | 1.0 | A | A | A | A | *9 | Inv. |
| 14 | 8 | 0.15 | 50 | 1.0 | 1.0 | A | A | A | B | *9 | Inv. |

TABLE 2-continued

| Combination No. | Photoreceptor No. | *1 | *2 | *3 | *4 | *5 | *6 | *7 | *8 | Image quality evaluation | Remarks |
|---|---|---|---|---|---|---|---|---|---|---|---|
| 15 | 1 | 0.09 | 50 | 1.0 | 1.0 | A | A | C | A | *12 | Inv. |
| 16 | 1 | 0.15 | 80 | 1.0 | 1.0 | B | B | B | C | *13 | Inv. |
| 17 | 1 | 0.15 | 30 | 1.0 | 1.0 | B | B | B | B | *14 | Inv. |

*1; Transferring surface pressure of primary transferring roller (g/cm$^2$)
*2; Repulsion elasticity of cleaning blade (%)
*3; Rz of intermediate transferring member (μm)
*4; Inroad depth into cleaning brush
*5; Cleaning ability
*6; Occurrence of line
*7; Occurrence of interior lacking of image
*8;: Cyclic image defect
*9; Both of character image and halftone image are good.
*10; Lines are appeared, not suitable for practical use.
*11; Image is roughed and sharpness is degraded.
*12; Image density is low a little.
*13; Cyclic image defects are observed a little.
*14; Character image is good; halftone image is roughed a little.
Inv.; Inventive
Comp.; Comparative Table 2 shows that the image forming method employing the intermediate transferring member and the photoreceptor having the creeping modulus according to the invention, Combinations No. 1 through 10 and 13 through 17, gives the evaluation results superior to those of the image forming method without the invention, Combinations 11 and 12. Namely, in Combination 11 employing Photoreceptor 5 having a creeping modulus of 4.2, insufficient cleaning is occurred so as to form line-shaped defect in the image since a rift is occurred at the edge portion of the cleaning blade. Besides, in Combination 12 employing Photoreceptor 6 having a creeping modulus of 0.9, a crack and a deep dent are formed on the photoreceptor so as to occur the cyclic image defects and the interior lacking of image. Among the combinations according to the invention, Combinations No. 1 through 10, 13 and 14 which satisfy the condition that the surface pressure of the intermediate transferring member is within the range of from 0.1 to 0.5 g/cm$^2$, and the repulsion elasticity of the cleaning blade is within the range of from 40 to 75 apparently show the improving effects of the invention.

The image defects caused by the insufficient cleaning and the insufficient transfer in the electrophotographic process employing the intermediate transferring member and the two-component developer can be prevented by the present invention. Consequently, the image forming method and the image forming apparatus can be provided, by which the character image and the halftone image are also improved.

The invention claimed is:

1. An image forming method comprising the steps of:

forming a latent image on an organic photoreceptor;

developing the latent image by using a two-component developer comprising a toner and a carrier to form a toner image on the photoreceptor;

primarily transferring the toner image on the photoreceptor to an intermediate transferring member having a ten-point surface roughness Rz of from 0.4 to 2.0 μm;

secondarily transferring the toner image transferred to the intermediate transferring member to a recording material; and cleaning a toner remained on the organic photoreceptor after transferring the toner image to the intermediate transferring member, wherein the organic photoreceptor has a creeping modulus of not less than 1% and less than 3.5%, measured by employing a Vickers indenter applying a load of 20 mN, and the photoreceptor is pressed to contact with the intermediate transferring member at the primary transferring step.

2. The image forming method of claim 1, wherein a surface energy lowering agent is supplied to a surface of the organic photoreceptor in the step of the developing the latent image.

3. The image forming method of claim 2, wherein the surface energy lowering agent is a metal salt of fatty acid.

4. The image forming method of claim 3, wherein the metal salt of fatty acid is zinc stearate.

5. The image forming method of claim 1, wherein the organic photoreceptor has a charge generation layer, a charge transfer layer and a surface layer.

6. The image forming method of claim 5, wherein the surface layer contains micro particles having a number average particle diameter of not less than 10 nm and less than 100 nm.

7. The image forming method of claim 1, wherein a cleaning blade used in the cleaning process has a repulsion elasticity of from 40 to 75 which is pressed to the organic photoreceptor for removing the remained toner.

8. The image forming method of claim 1, wherein the carrier is a ferrite particle.

9. The image forming method of claim 8, wherein the carrier is a resin coated carrier or a resin-dispersed carrier.

10. The image forming method of claim 9, wherein the carrier is a magnetic particle-dispersed resin carrier.

11. The image forming method of claim 1, wherein the intermediate transferring member is a belt.

12. The image forming method of claim 11, wherein the belt intermediate transferring member is contacted to the organic photoreceptor by a surface pressure of from 0.1 to 0.5 g/cm$^2$ at a time of primary transferring.

13. The image forming method of claim 11, wherein the photoreceptor is pressed by intermediate transferring member with a transfer roller.

14. The image forming method of claim 1, wherein the intermediate transferring member is contacted to the organic photoreceptor by a surface pressure of from 0.1 to 0.5 g/cm$^2$ at a time of primary transferring.

* * * * *